US010878796B2

(12) United States Patent
Zhao et al.

(10) Patent No.: US 10,878,796 B2
(45) Date of Patent: Dec. 29, 2020

(54) MOBILE PLATFORM BASED ACTIVE NOISE CANCELLATION (ANC)

(71) Applicant: Samsung Electronics Co., Ltd., Suwon-si (KR)

(72) Inventors: Ye Zhao, Mountain View, CA (US); Cody Wortham, San Francisco, CA (US); James Young, San Francisco, CA (US); Sajid Sadi, Mountain View, CA (US); Paul Kim, Santa Clara, CA (US); Bo Hyun Moon, Los Altos, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/521,069

(22) Filed: Jul. 24, 2019

(65) Prior Publication Data

US 2020/0118537 A1 Apr. 16, 2020

Related U.S. Application Data

(60) Provisional application No. 62/743,995, filed on Oct. 10, 2018.

(51) Int. Cl.
*G10K 11/178* (2006.01)

(52) U.S. Cl.
CPC .. *G10K 11/17823* (2018.01); *G10K 11/17853* (2018.01); *G10K 2210/1081* (2013.01); *G10K 2210/3025* (2013.01); *G10K 2210/3028* (2013.01); *G10K 2210/3044* (2013.01)

(58) Field of Classification Search
USPC ..... 381/13, 71.1, 71.6, 73.1, 94.1, 94.5, 317
See application file for complete search history.

(56) References Cited

U.S. PATENT DOCUMENTS

| | | | |
|---|---|---|---|
| 8,249,265 | B2 | 8/2012 | Shumard |
| 9,082,389 | B2 | 7/2015 | Nicholson et al. |
| 9,648,410 | B1 | 5/2017 | Kratsas et al. |

(Continued)

FOREIGN PATENT DOCUMENTS

| | | | |
|---|---|---|---|
| CN | 108428445 | A | 8/2018 |
| JP | 5364098 | B2 | 12/2013 |

OTHER PUBLICATIONS

Notification of Transmittal of the International Search Report and the Written Opinion of the International Searching Authority, or the Declaration dated Jan. 17, 2020 in connection with International Patent Application No. PCT/KR2019/013056, 10 pages.

*Primary Examiner* — Yosef K Laekemariam

(57) ABSTRACT

A system and method for remote active noise correction at a remote device includes receiving, at the remote device, an ambient noise signal from a microphone. The remote device is disposed along a processing and transmission path between the microphone and a headphone. The processing and transmission path exhibit non-zero latency. The remote device further analyzes the ambient noise signal to generate an anti-noise signal, performs a first correction of the anti-noise signal for a headphone interface effect, performs a second correction of the anti-noise signal for the non-zero latency of the processing and transmission path between the microphone and the headphone. The remote device then transmits the corrected anti-noise signal to the headphone.

20 Claims, 14 Drawing Sheets

(56) References Cited

U.S. PATENT DOCUMENTS

| | | | | |
|---|---|---|---|---|
| 9,824,677 | B2 * | 11/2017 | Kwatra | G10K 11/178 |
| 2015/0365761 | A1 | 12/2015 | Alderson et al. | |
| 2016/0086595 | A1 | 3/2016 | Asada et al. | |
| 2017/0339484 | A1 | 11/2017 | Kim | |
| 2018/0255390 | A1 | 9/2018 | Ozluturk | |
| 2019/0088243 | A1 * | 3/2019 | Prasad | G10K 11/175 |
| 2019/0259371 | A1 * | 8/2019 | Ueno | G10K 11/17883 |
| 2019/0273982 | A1 * | 9/2019 | Petrank | H04R 1/1041 |

* cited by examiner

MOBILE PLATFORM BASED ACTIVE NOISE CANCELLATION (ANC)

CROSS-REFERENCE TO RELATED APPLICATION AND CLAIM OF PRIORITY

This application claims priority under 35 U.S.C. § 119(e) to U.S. Provisional Patent Application No. 62/743,995 filed on Oct. 10, 2018. The above-identified provisional patent application is hereby incorporated by reference in its entirety.

TECHNICAL FIELD

This disclosure relates generally to audio processing. More specifically, this disclosure relates to mobile platform based active noise cancellation.

BACKGROUND

Managing background noise (for example, from traffic, airplanes, or background conversation) in a way that comports with users' preferences regarding headphone choice and desire for good auditory health presents a persistent and unresolved technical challenge in providing a satisfactory (relative to listening in a quiet environment) headphone listening experience.

While some users may be willing to manage background noise by simply increasing headphone volume relative to the amplitude of background noise, this approach, which potentially increases battery consumption and the risk of long-term hearing loss, is unacceptable to many users. Similarly, specialized active noise canceling headphones, which use a reference microphone on the exterior of the headphone to receive an ambient noise waveform, and use processing hardware within the headphone to generate an inverted ambient noise waveform, deprive users of the ability to choose headphones which are compatible with their budget, activity preferences and style preferences, are likewise unacceptable to many users.

For many users, inexpensive headphones, such as "ear-bud" style headphones with an in-line microphone, present an inexpensive solution to many real-world issues arising with headphones in a way that specialized headphones implementing integrated, hardware based active noise cancellation cannot. For example, inexpensive headphones are, in most parts of the world, widely available in a variety of colors, styles, and points of sale, which facilitates their use in a wide range of activities (for example, running, cycling, walking through urban crowds) and other contexts where users would be discouraged from using bulkier, expensive headphones. At the same time, embodiments according to this disclosure also permit post hoc implementation of active noise cancellation across other types of headphones (for example, the vintage, over-the-ear style headphones favored by certain audiophiles) which do not have a native active noise cancellation functionality.

Accordingly, implementing active noise cancellation through a wide range of headphones (such as inexpensive headphones which can be worn (and lost) without issue while engaging in active pursuits) remains an ongoing technical challenge and source of opportunities for improving noise cancellation technology.

SUMMARY

This disclosure provides systems and methods for mobile platform based active noise cancellation ("ANC").

In a first embodiment, a method of remote active noise correction at a remote device includes receiving, at the remote device, an ambient noise signal from a microphone, wherein the remote device is disposed along a processing and transmission path between the microphone and a headphone, the processing and transmission path exhibiting non-zero latency. The method further includes analyzing the ambient noise signal to generate an anti-noise signal, performing a first correction of the anti-noise signal for a headphone interface effect, performing a second correction of the anti-noise signal for the non-zero latency of the processing and transmission path between the microphone and the headphone, and transmitting the corrected anti-noise signal to the headphone.

In a second embodiment, a remote device includes an audio interface connected to a microphone and a headphone, a processor, and a memory. The memory contains instructions, which, when executed by the processor cause the remote device to receive an ambient noise signal from the microphone, wherein the remote device is disposed along a processing and transmission path between the microphone and the headphone, the processing and transmission path exhibiting non-zero latency. Additionally, when executed by the processor, the instructions further cause the remote device to analyze the ambient noise signal to generate an anti-noise signal, perform a first correction of the anti-noise signal for a headphone interface effect, perform a second correction of the anti-noise signal for the non-zero latency of the processing and transmission path between the microphone and the headphone, and transmit the corrected anti-noise signal to the headphone.

In a third embodiment, a non-transitory, computer-readable medium includes program code, which when executed by a processor, causes a remote device to receive, at the remote device, an ambient noise signal from a microphone, wherein the remote device is disposed along a processing and transmission path between the microphone and a headphone, the processing and transmission path exhibiting non-zero latency. When executed by the processor, the program code further causes the remote device to analyze the ambient noise signal to generate an anti-noise signal, perform a first correction of the anti-noise signal for a headphone interface effect, perform a second correction of the anti-noise signal for the non-zero latency of the processing and transmission path between the microphone and the headphone, and transmit the corrected anti-noise signal to the headphone.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 12F, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged electronic device.

Figure 1:
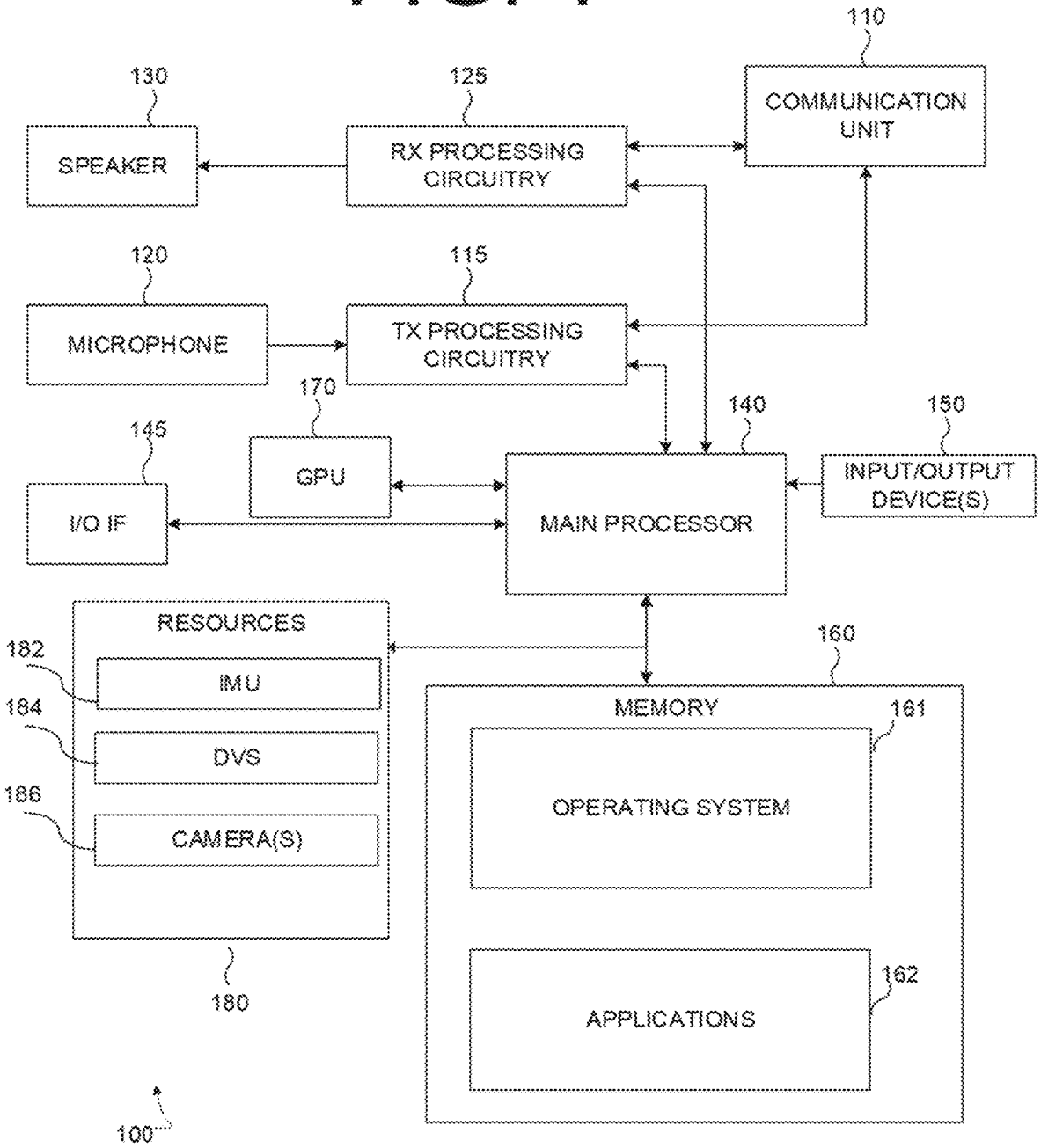
FIG. 1 illustrates an example of a platform for performing active noise cancellation according to embodiments of this disclosure.

FIG. 1 illustrates a non-limiting example of a device for implementing active noise cancellation on a remote and/or mobile platform, according to some embodiments of this disclosure. The embodiment of device 100 illustrated in FIG. 1 is for illustration only, and other configurations are possible. However, suitable devices come in a wide variety of configurations, and FIG. 1 does not limit the scope of this disclosure to any particular implementation of a device. For example, device 100 may be implemented, without limitation, as a smartphone, a wearable smart device (such as a smart watch), a tablet computer, or as a head-mounted display.

As shown in the non-limiting example of FIG. 1, the device 100 includes a communication unit 110 that may include, for example, a radio frequency (RF) transceiver, a BLUETOOTH® transceiver, or a WI-FI® transceiver, etc., transmit (TX) processing circuitry 115, a microphone 120, and receive (RX) processing circuitry 125. The device 100 also includes a speaker 130, a main processor 140, an input/output (I/O) interface (IF) 145, input/output device(s) 150, and a memory 160. The memory 160 includes an operating system (OS) program 161 and one or more applications 162.

Applications 162 can include games, social media applications, applications for geotagging photographs and other items of digital content, virtual reality (VR) applications, augmented reality (AR) applications, operating systems, device security (e.g., anti-theft and device tracking) applications or any other applications which access resources of device 100, the resources of device 100 including, without limitation, speaker 130, microphone 120, input/output devices 150, and additional resources 180. According to some embodiments, applications 162 include applications which provide audio content, including, without limitation, music players, podcasting applications, and digital personal assistant applications.

The communication unit 110 may receive an incoming RF signal, for example, a near field communication signal such as a BLUETOOTH® or WI-FI signal. The communication unit 110 can down-convert the incoming RF signal to generate an intermediate frequency (IF) or baseband signal. The IF or baseband signal is sent to the RX processing circuitry 125, which generates a processed baseband signal by filtering, decoding, or digitizing the baseband or IF signal. The RX processing circuitry 125 transmits the processed baseband signal to the speaker 130 (such as for voice data) or to the main processor 140 for further processing (such as for web browsing data, online gameplay data, notification data, or other message data). Additionally, communication unit 110 may contain a network interface, such as a network card, or a network interface implemented through software. In certain embodiments, communication unit 110 operates as an audio interface, with aspects of the audio functionality, such as converting audio signals to digital signals and vice versa, being implemented through communication unit 110. In some embodiments, device 100 may also include a separate audio processor for managing and converting digital and analog audio signals.

The TX processing circuitry 115 receives analog or digital voice data from the microphone 120 or other outgoing baseband data (such as web data, e-mail, or interactive video game data) from the main processor 140. The TX processing circuitry 115 encodes, multiplexes, or digitizes the outgoing baseband data to generate a processed baseband or IF signal. The communication unit 110 receives the outgoing processed baseband or IF signal from the TX processing circuitry 115 and up-converts the baseband or IF signal to an RF signal for transmission.

The main processor 140 can include one or more processors or other processing devices and execute the OS program 161 stored in the memory 160 in order to control the overall operation of the device 100. For example, the main processor 140 could control the reception of forward channel signals and the transmission of reverse channel signals by the communication unit 110, the RX processing circuitry 125, and the TX processing circuitry 115 in accordance with well-known principles. In some embodiments, the main processor 140 includes at least one microprocessor or microcontroller.

The main processor 140 is also capable of executing other processes and programs resident in the memory 160. The main processor 140 can move data into or out of the memory 160 as required by an executing process. In some embodiments, the main processor 140 is configured to execute the applications 162 based on the OS program 161 or in response to inputs from a user or applications 162. Applications 162 can include applications specifically developed for the platform of device 100, or legacy applications developed for earlier platforms. Additionally, main processor 140 can be manufactured to include program logic for implementing methods for monitoring suspicious application access according to certain embodiments of the present disclosure. The main processor 140 is also coupled to the I/O interface 145, which provides the device 100 with the ability to connect to other devices such as laptop computers and handheld computers. The I/O interface 145 is the communication path between these accessories and the main processor 140.

The main processor 140 is also coupled to the input/output device(s) 150. The operator of the device 100 can use the input/output device(s) 150 to enter data into the device 100. Input/output device(s) 150 can include keyboards, head mounted displays (HMD), touch screens, mouse(s), track balls or other devices capable of acting as a user interface to allow a user to interact with electronic device 100. In some embodiments, input/output device(s) 150 can include a touch panel, a (digital) pen sensor, a key, or an ultrasonic input device.

Input/output device(s) 150 can include one or more screens, which can be a liquid crystal display, light-emitting diode (LED) display, an optical LED (OLED), an active matrix OLED (AMOLED), or other screens capable of rendering graphics.

The memory 160 is coupled to the main processor 140. According to certain embodiments, part of the memory 160 includes a random access memory (RAM), and another part of the memory 160 includes a Flash memory or other read-only memory (ROM). Although FIG. 1 illustrates one example of a device 100. Various changes can be made to FIG. 1.

For example, according to certain embodiments, device 100 can further include a separate graphics processing unit (GPU) 170.

According to certain embodiments, electronic device 100 includes a variety of additional resources 180 which can, if permitted, be accessed by applications 162. According to certain embodiments, additional resources 180 include an accelerometer or inertial motion unit 182, which can detect movements of the electronic device along one or more degrees of freedom. Additional resources 180 include, in some embodiments, a dynamic vision sensor (DVS) 184, one or more cameras 186 of electronic device 100.

Although FIG. 1 illustrates one example of a device 100 for performing active noise cancellation, various changes may be made to FIG. 1. For example, the device 100 could include any number of components in any suitable arrangement. In general, devices including computing and communication systems come in a wide variety of configurations, and FIG. 1 does not limit the scope of this disclosure to any particular configuration. While FIG. 1 illustrates one operational environment in which various features disclosed in this patent document can be used, these features could be used in any other suitable system.

Figure 2:
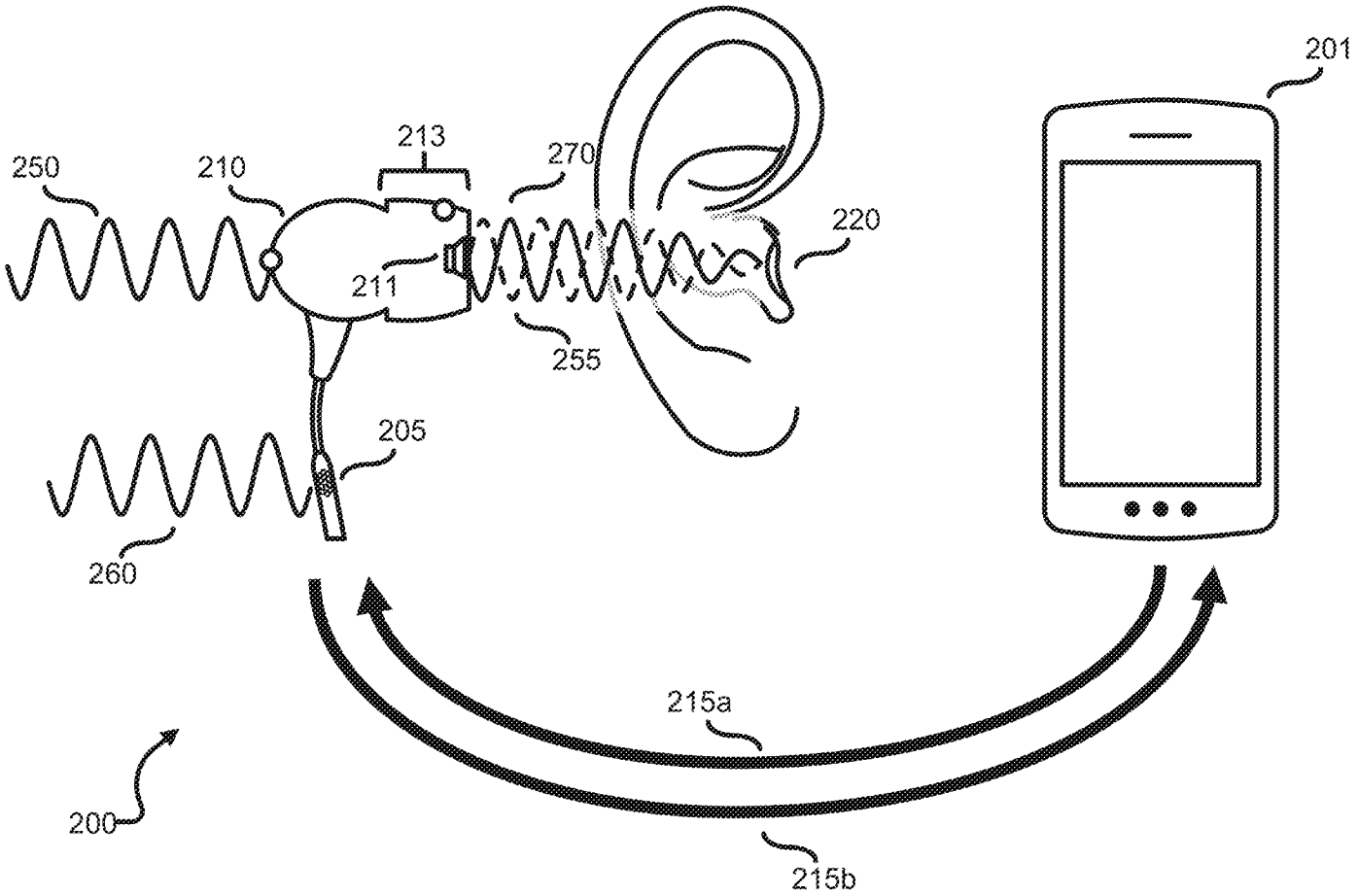
FIG. 2 illustrates aspects of mobile platform based active noise cancellation according to embodiments of this disclosure.

FIG. 2 illustrates aspects of mobile platform based active noise cancellation according to certain embodiments of this disclosure. The embodiment shown in FIG. 2 is for illustration only and other embodiments could be used without departing from the scope of the present disclosure.

Referring to the non-limiting example of FIG. 2, a context 200 for implementing active noise cancellation according to certain embodiments of this disclosure is shown. According to certain embodiments, context 200 includes remote device 201 (for example, device 100 in FIG. 1), which is an electronic device comprising a processor, a memory, and an audio interface for receiving audio signals from microphone 205 and providing audio signals to be reproduced by a speaker 211 of headphone 210. Speaker 211 comprises a transducer which converts electrical signals into audible sound to be heard at a designated listening point 220. In certain embodiments according to this disclosure, designated listening point 220 comprises a point in a listener's ear. Further, headphone 210 can include a headphone interface 213, consisting of an earcup, earplug, or other structure to comfortably connect headphone 210 to a listener's ear, and in some embodiments, exclude some ambient sounds from a path between speaker 211 and designated listening point 220. Headphones which can function as headphone 210 can come in a variety of configurations. According to certain embodiments, headphone 210 is a wireless (for example, connected via BLUETOOTH) headphone set with microphone 205 integrated into a portion of a speaker housing.

Referring to the non-limiting example of FIG. 2, a first portion 250 of the ambient noise (including, without limitation, the sounds of traffic, other people's conversations, and the sounds of nature) of context 200 passes through and around headphone 210, and is received at designated listening point 220 as received noise 255. According to certain embodiments, received noise 255 comprises one or more waveforms based on first portion 250 of the ambient noise of context 200, but which are modified (for example, attenuated and/or phase shifted at certain frequencies) through interactions with a listener's head, ear canal and surfaces of headphone 210 (for example, headphone interface 213).

Additionally, in certain embodiments according to this disclosure, a second portion 260 of the ambient noise of context 200 is received at microphone 205 and converted to an electrical signal received at remote device 201. In the illustrative example of FIG. 2, the electrical signal received from microphone 205 at remote device 201 is related to received noise 255, but differs (for example, with regard to amplitude and phase across its constituent frequencies) due to, for example, acoustic effects of a listener's head and the sensitivity and response characteristics of microphone 205.

According to certain embodiments of this disclosure, remote device 201 receives the second portion 260 of the ambient noise of context 200 from microphone 205 as an electrical signal, and processes the signal to generate an anti-noise signal 270, which compensates for, without limitation, the above-described acoustic effects of the headphone (for example, the effects causing first portion 250 of the ambient noise to be heard by a user as received noise 255), the non-zero latency of the transmission and processing path between microphone 205 and headphone 210, and the positional and response effects (for example, the effects creating a difference between received noise 255 and the electrical signal generated by microphone 205 in response to second portion 260 of the ambient noise of context 200). In some certain embodiments of this disclosure, anti-noise signal 270 includes an audio signal whose amplitudes in a frequency domain are substantially similar to those of received noise 255, but whose phase is shifted 180 degrees (or 7C radians). When reproduced by speaker 211, anti-noise 270 has the effect of cancelling out most, if not all, of received noise 255 at designated listening point 220.

According to certain embodiments, microphone 205 and headphone 210 are part of a wired or wireless headphone/microphone set commonly used to provide a hands-free communication function for remote device 201. In some embodiments, headphone 210 and microphone 205 are connected, via a common cable housing, such that headphone 210 goes in, or on top of a user's ear, and microphone 205 (sometimes referred to as an "in-line microphone" dangles from headphone 210 at a location generally proximate to most user's mouths. As shown in the illustrative example of FIG. 2, microphone 205 provides an audio signal via transmission path 215B, which in some embodiments, comprises a cable or wire connecting microphone 205 to remote device 201. Similarly, and as shown in the non-limiting example of FIG. 2, remote device 201 provides headphone 210 with audio signals via transmission path 215A. In certain embodiments according to this disclosure, sounds received at microphone 205 can be passed via transmission path 215B to remote device to be processed (for example, digitized, filtered and then converted back to analog) and sent via transmission path 215A for playback at headphone 210. According to certain embodiments, the time interval between a sound being received at microphone 205, processed at remote device 201, and played back at headphone 210 is on the order of 50-100 ms. Thus, in various embodiments according to this disclosure, remote device 201 is disposed along a processing and transmission path between microphone 205 and headphone 210 exhibiting non-zero latency. Moreover, in some embodiments, transmission paths, such as transmission paths 215A and 215B can be wireless (for example, a wireless transmission path via BLUETOOTH).

Figure 3:
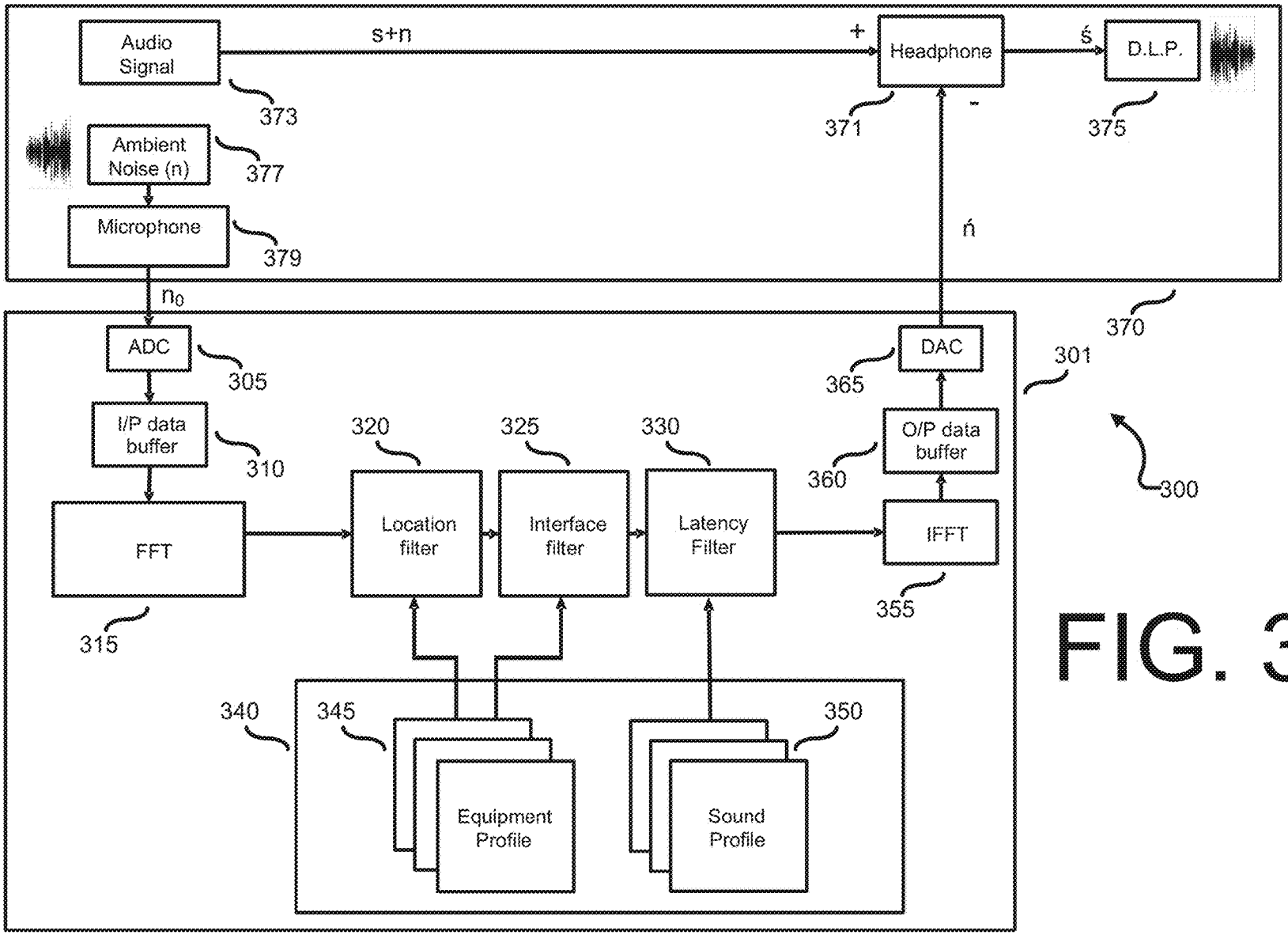
FIG. 3 illustrates, in block diagram format, an example of a platform for active noise cancellation according to embodiments of this disclosure.

FIG. 3 illustrates, in block diagram format, an example of a platform 300 for active noise cancellation according to certain embodiments of this disclosure. The embodiment of the platform 300 shown in FIG. 3 is for illustration only. Other embodiments could be used without departing from the scope of the present disclosure.

In the non-limiting example shown in FIG. 3, platform 300 includes remote device 301 and audio input-output componentry 370.

According to certain embodiments, audio input-output componentry 370 includes a headphone 371 comprising a speaker or other transducer which receives electrical signals corresponding to an audio signal 373 (for example, music or a podcast), and an anti-noise signal ń, and converts the electrical signals into a sound wave ś, which is received at a designated listening point 375. In certain embodiments, designated listening point 375 is a human listener's ear. In certain embodiments, the designated listening point 375 is an animal's ear or another apparatus.

As shown in the example of FIG. 3, audio input-output componentry 370 is situated in a context (for example, context 200 in FIG. 2) in which ambient noise (n) 377 is present, and absent cancellation (for example, by reproducing anti-noise signal 11 at headphone 371), can be heard at designated listening point 375. In some embodiments, ambient noise (n) 377 is received at a microphone 379 and converted by microphone 379 to an analog electrical signal $n_0$.

In certain embodiments according to this disclosure, audio input-output componentry 370 are embodied as a single accessory device (for example, an inexpensive set of earbuds with an in-line microphone) and two or more cables or an inexpensive set of wireless earbuds with a microphone, which connect to remote device 301 via a standard interface (for example, a micro-USB jack or a wireless BLUETOOTH connection interface) to form a transmission and processing path between microphone 379 and headphone 371 which exhibits non-zero latency. In certain embodiments, microphone 379 is a separate component from headphone 371 (for example, an in-device microphone of remote device 301).

In some embodiments according to this disclosure remote device 301 comprises an electronic device (for example, electronic device 100 in FIG. 1) comprising a processor, a memory, and an audio interface (for example, an audio processor or communication unit 110 in FIG. 1).

Referring to the illustrative example of FIG. 3, remote device 301 comprises analog to digital converter (ADC) 305, which receives an electrical signal $n_0$ based on the ambient noise in the environment including audio input-output componentry 370, and converts electrical signal $n_0$ into digital sound data comprising a representation of $n_0$ in a time domain, which is then stored in an input data buffer 310.

According to certain embodiments, a fast Fourier transform (FFT) 315 is performed on the digital sound data in input data buffer 310. According to certain embodiments, FFT 315 is performed by program code executed by a processor (for example, main processor 140 in FIG. 1) of remote device 301 or by a dedicated FFT processor chip.

In certain embodiments, the FFT 315 of $n_0$ is passed through one or more of a plurality of filters to generate an anti-noise signal ń that is adjusted for one or more of microphone location effects (as one example, the microphone location effects described with reference to FIG. 10 of this disclosure), the non-zero latency associated with the processing and transmission path between microphone 379 and headphone 371, and headphone interface effects (as one example, the headphone interface effects described with reference to FIG. 5 of this disclosure).

According to certain embodiments, FFT 315 is passed through a location filter 320 which processes FFT 315 to account for a variety of acoustic effects creating a differential between the actual ambient noise at a headphone and the electrical signal detected by a microphone. Acoustic effects which location filter 320 can account for include, without limitation, the predicted effects of microphone 379's response curve and the physical separation between designated listening point 375 and microphone 379. In some cases, the ambient noise 377 interaction with the variously fleshy and bony surfaces of a user's head and ear create differences (for example, phase shifts and attenuation across certain frequency ranges) in the sound of ambient noise as perceived at microphone 379 and designated listening point 375. Further, microphone 379's response curve may not be flat, meaning that the amplitude of an electrical signal output by microphone 379 may vary across frequencies. Additionally, microphone 379 may have a limited dynamic range, resulting in a compression effect. According to certain embodiments, location filter 320 applies corrections (for example, adjusting the imaginary components of the FFT of $n_0$ to account for phasing effects) based on one or more models of the acoustic effects of a user's head and ear for a given microphone and microphone location. According to certain embodiments, remote device 301 includes a user-end calibration application 340, which includes one or more equipment profiles 345. As shown in FIG. 3, the one or more equipment profiles allow a user to specify (or remote device 301, to detect) the specific microphone/headphone combination being used. In some embodiments, location filter 320 selects the model compensating for the acoustic effects of the microphone (for example, Brand "A" earbuds may have a flatter response curve and higher dynamic range than Brand "B" earbuds) based on an equipment profile from one or more equipment profiles 345.

Referring to the non-limiting example of FIG. 3, FFT 315 is, in some embodiments passed through interface filter 325, which adjusts components of FFT 315 to account for the acoustic effects created by a headphone interface (for example, headphone interface 213 in FIG. 2). In certain embodiments, headphone interfaces (for example, the earcups and/or earplugs which help keep headphones in place during use) exclude some, but not all, of the outside noise. Thus, the headphone interface acts as a filter (for example, a low-pass filter which primarily excludes high frequency sounds from reaching designated listening point 375) whose behavior can be predicted and compensated by one or models. According to some embodiments, interface filter 325 selects a model for compensating for the predicted effects of a headphone interface based on an equipment profile from one or more equipment profiles 345.

As shown in FIG. 3, FFT 315 is, in certain embodiments according to this disclosure, further processed by latency filter 330 which compensates for the native transmission and processing delays associated with receiving an ambient noise signal at microphone 379, processing an electronic signal at remote device 301 to generate an anti-noise signal 11 and transmitting and reproducing same at headphone 371. According to various embodiments, latency filter 330 compensates for the delay associated with the transmission and processing path by applying one or more models reflecting the predicted delay of a transmission and processing path, as well as the predicted dominant frequencies of the ambient noise. In some embodiments, the predicted dominant frequencies of the ambient noise can be predicted based on historical noise data. In some embodiments, user-end calibration 340 includes one or more sound profiles 350 that can be selected by a user through a user interface provided by user-end calibration application 340 (for example, a user can select sound profiles corresponding to "construction site" or "subway platform"). In certain embodiments, a sound profile from one or more sound profiles 350 is selected based on contextual data (for example, where location information indicates that remote device 301 is at a location near an airport, a sound profile corresponding to "jet engine noise" may be automatically selected). As shown in FIG. 3, a model for compensating for the latency effects is chosen based on the selected sound profile.

Referring to the non-limiting example of FIG. 3, after correcting FFT 315 for one or more of location effects, headphone interface effects or latency effects in a transmission and processing path, and inverse fast Fourier transform (IFFT) 355 of the corrected FFT is generated and stored in output data buffer 360. According to some embodiments, IFFT 355 is generated by program code executing on a processor of remote device 301. In certain embodiments, IFFT 355 is generated by a dedicated FFT/IFFT processor. As shown in the non-limiting example of FIG. 3, IFFT 355 converts the representation of a corrected noise signal in the frequency domain into a representation of the noise signal in the time domain. In certain embodiments, IFFT 355 applies a 180 degree phase shift to the frequency components of the corrected noise signal to generate an anti-noise signal. In some embodiments, the application of a 180 phase shift is performed by an upstream component (for example, latency filter 330) or a downstream component (for example, DAC 365).

In various embodiments according to this disclosure, a digital representation of an anti-noise signal is converted by digital to analog converter (DAC) 365 and transmitted to headphone 371 as anti-noise signal ń.

Figure 4:
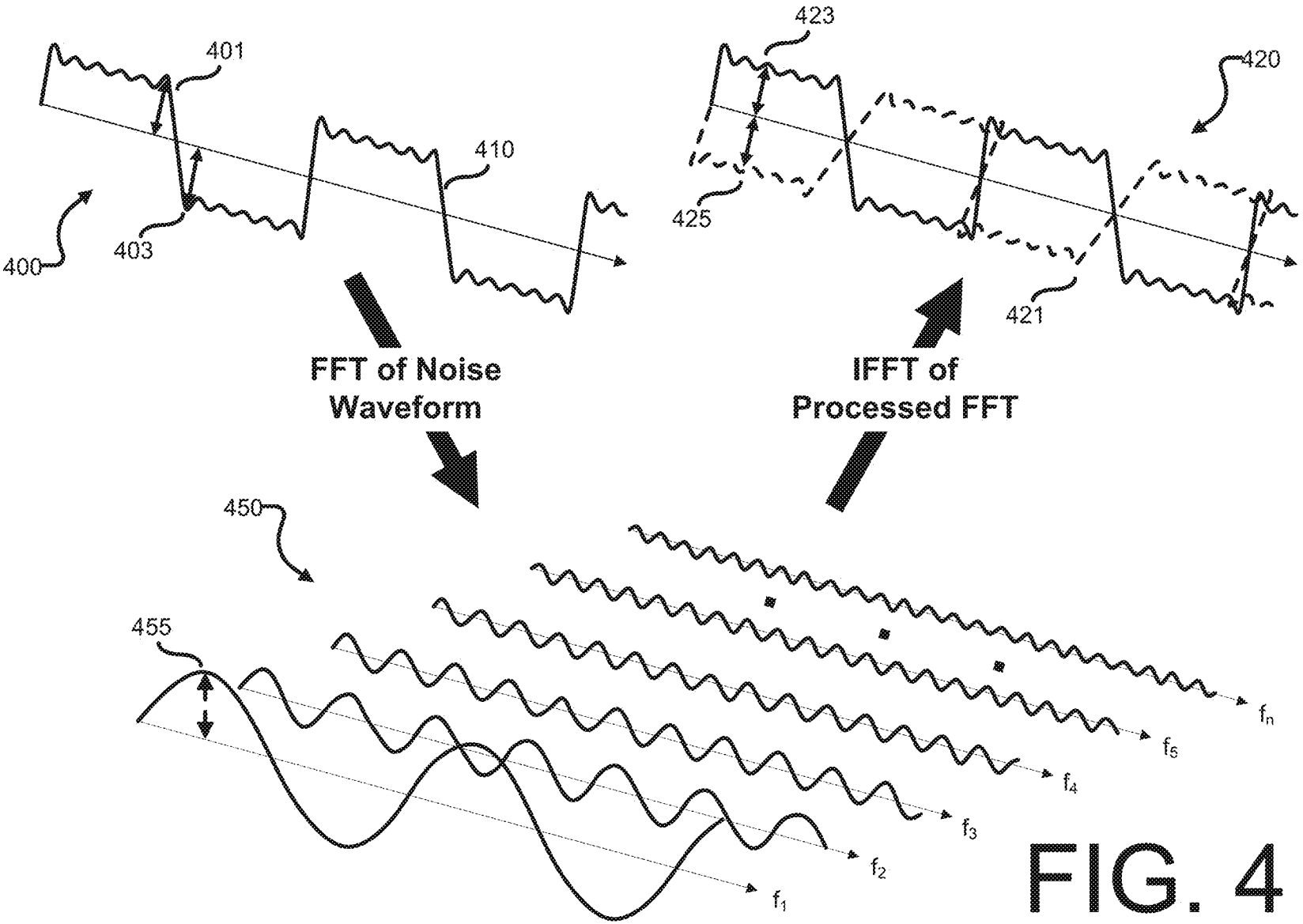
FIG. 4 illustrates an example of aspects of a fast Fourier transform and generation of an anti-noise signal according to embodiments of this disclosure.

FIG. 4 illustrates aspects of a fast Fourier transform and generation of an anti-noise signal according to some embodiments of this disclosure. The transform and generation of the anti-noise signal shown in FIG. 4 is for illustration only and other transforms (for example, a wavelet transform) and generation methods could be used without departing from the scope of the present disclosure.

In the non-limiting example shown in FIG. 4, a first plot 400 of a sound (for example, ambient noise) in a time domain is shown in the upper left part of FIG. 4. First plot 400 shows fluctuations in amplitude over time. For audible sounds, the amplitude corresponds to the magnitude of a fluctuation in the pressure of a medium (for example, air) at a designated listening point (for example, designated listening point 375) in FIG. 3. As shown in FIG. 4, amplitude can be a positive amplitude (for example, first amplitude 401) corresponding to an increase in air pressure at the designated listening point, or the amplitude can be a negative amplitude (for example, second amplitude 403) corresponding to a decrease in the medium at the listening point. Sound is additive, in the sense that an increase in air pressure created by a first source of sound (for example, a train passing by) can be cancelled by a simultaneous decrease in air pressure created by a second source of sound (for example, speaker 211 in FIG. 2).

In the purely illustrative example of FIG. 4, second plot 420 shows a superposition of the sound in first plot 400 with an anti-sound 421 (shown with a dotted line). In this explanatory example, the amplitude of anti-sound 421 is of equal value and opposite sign to that of the sound in first plot 400. That is, at a time where the first sound creates an increase in pressure 423 of a given magnitude, anti-sound 421 creates a decrease in pressure 425 of equal magnitude. To a listener, the addition of the first sound and anti-sound 421 creates a cancellation effect, with the listener neither hearing the first sound nor anti-sound 421.

Thus, at a fundamental level, generating an anti-sound, or noise cancelling signal requires knowing the magnitude and timing of the fluctuations in amplitude created by an unwanted sound. According to some embodiments, an unwanted sound can be captured (for example, by microphone 379 in FIG. 3) as an electronic signal which can be analyzed to determine the timing and size of fluctuations in amplitude. As shown in the example of FIG. 4, the analysis of the sound can, in certain embodiments, be done by performing a fast Fourier transform (FFT) of a waveform (for example, waveform 410) in a time domain, to generate a representation 450 of the waveform in a frequency domain. Recalling that, in certain embodiments, sound (and sound waves) are additive, representation 450 breaks waveform 410 down into a superposition of n (where n is an arbitrarily chosen integer) sample waveforms whose defining parameters include characteristic frequency (for example, $f_1$, $f_2 \ldots f_n$), amplitude (for example, amplitude 455) and phase. According to some embodiments, one or more processes or modules of an electronic device (for example, remote device 301 in FIG. 3) can process the FFT by changing the values of the defining parameters of waveforms 1 through n. As one example of changing the values of the defining parameters of the constituent waveforms of an FFT, the phase of the characteristic waveforms can be shifted by 180 degrees (or $\pi$ radians). In certain embodiments, an inverse fast Fourier transform (IFFT) can be used to convert the processed representation of waveform 410 in the frequency domain back into the time domain (for example, as anti-sound 421).

Figure 5:
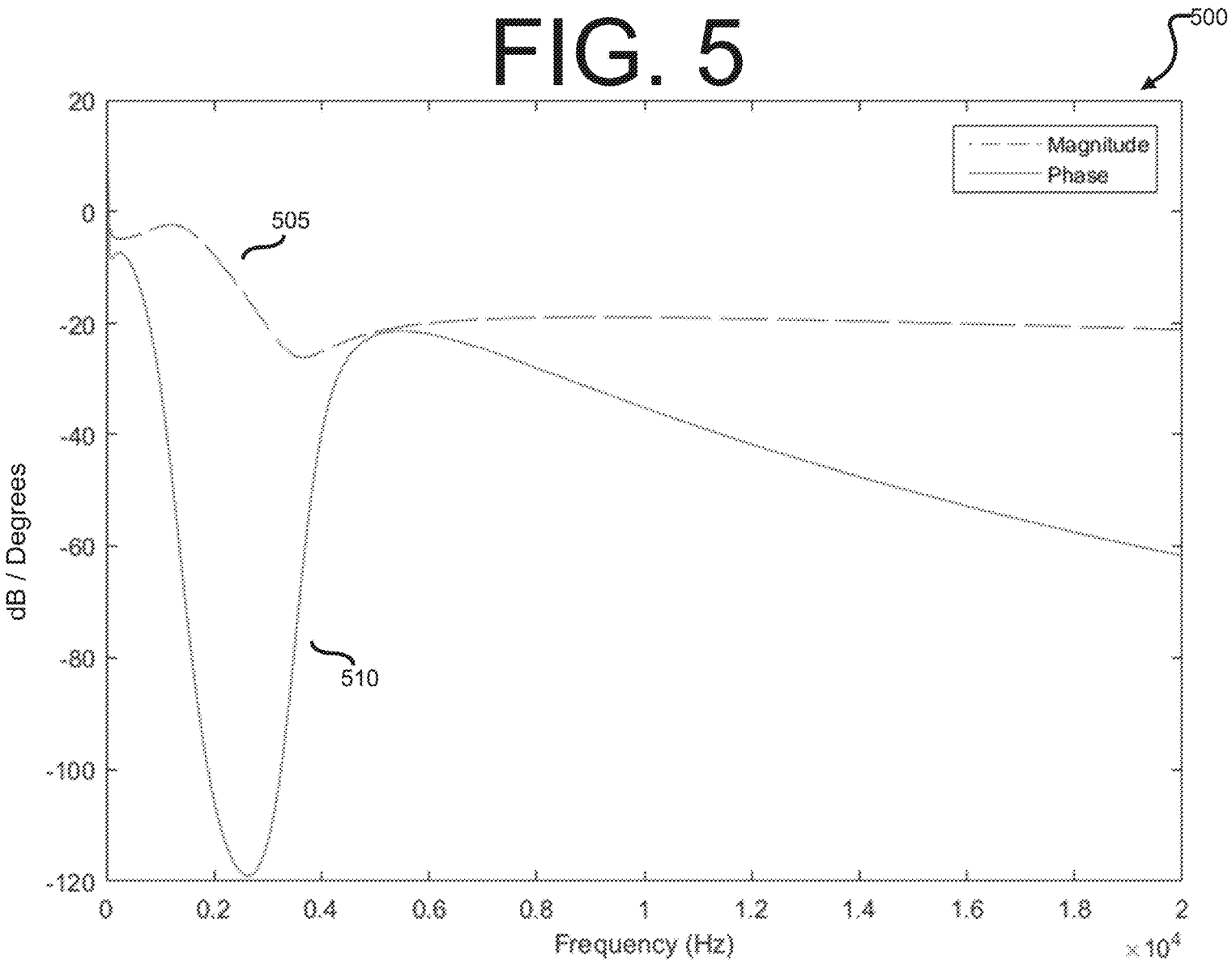
FIG. 5 illustrates an example of a headphone interface effect addressed by active noise cancellation according to embodiments of this disclosure.

FIG. 5 illustrates an example of a headphone interface effect corrected by active noise cancellation according to certain embodiments of this disclosure. The example shown in FIG. 5 is for illustration only and other examples could be depicted, produced, or obtained, without departing from the scope of the present disclosure.

As discussed elsewhere in this disclosure, interactions between sound waves and the surfaces of a headphone interface, such as an ear cup or ear plug, which help retain a transducer or speaker of the headphone in a relatively fixed position relative to a designated listening point, can have the effect of altering the sound waves as received at the designated listening point.

In the non-limiting example shown in FIG. 5, a graph 500 of measured amplitude and phase effects created by one type of earbud-style headphone interface at a designated listening point are shown. A first plot 505 (shown as a dashed line) shows the change in amplitude of sound waves passing by a headphone interface across the range of frequencies shown on the horizontal axis of graph 500. According to some embodiments, such as in the example shown in FIG. 5, the headphone interface acts as a low-pass filter, by providing an approximately 20 db reduction in amplitude for frequencies above 4000 Hertz (Hz), while providing less attenuation for frequencies below 4000 Hz.

According to some embodiments, interaction with the surfaces of a headphone interface also creates frequency-dependent phase shift effects. Second plot 510 (shown as a solid line) in FIG. 5 provides a non-limiting example of the measured phase shift at a designated listening point across a range of frequencies. For a particular earbud, the phase effect comprises a complex function with a deep trough between approximately 0 and 4000 Hz and a steadily decreasing shift at frequencies above 4000 Hz.

In certain embodiments of this disclosure, instances of graph 500 can be generated for a range of headphones and headphone interfaces and used to build models (for example, models maintained in equipment profile 345 in FIG. 3) of the phase and amplitude effects, which can be applied (for example, by interface filter 325 in FIG. 3) to the constituent waveforms of a FFT of a noise signal (for example, FFT 315 in FIG. 3) to account for the predicted differences of an ambient noise signal passing directly into a microphone (for example, microphone 205 in FIG. 2), and an ambient noise signal interacting with a headphone interface (for example, headphone interface 213 in FIG. 2) before reaching a designated listening point (for example, DLP 220 in FIG. 2).

Figure 6:
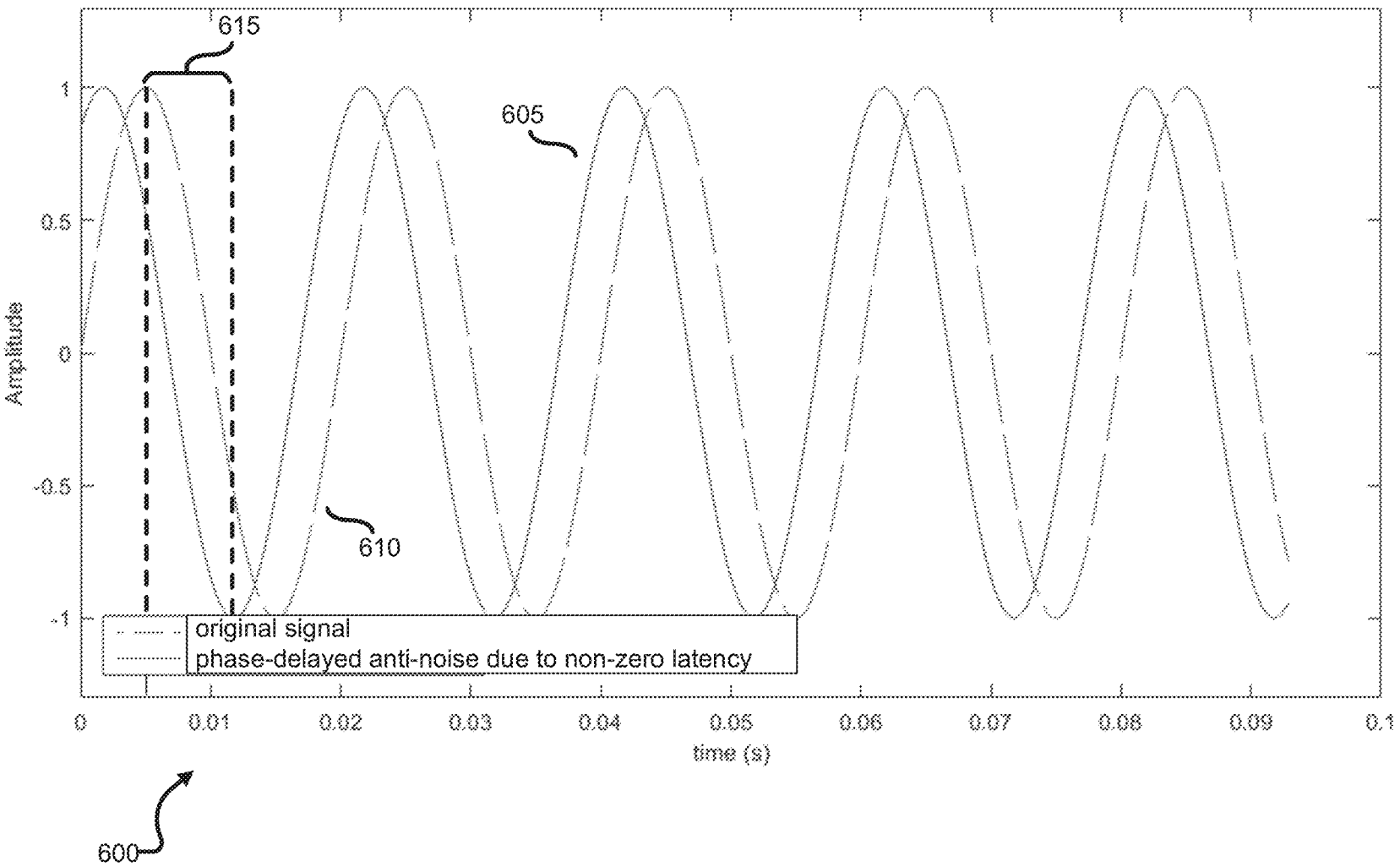
FIG. 6 illustrates an example of a correction for a non-zero latency in a processing and transmission path between a microphone and headphone according to embodiments of this disclosure.

FIG. 6 illustrates an example of a correction for a non-zero latency in a processing and transmission path between a microphone and headphone according to certain embodiments of this disclosure. The example shown in FIG. 6 is for illustration only and other examples could be depicted, produced, or obtained, without departing from the scope of the present disclosure.

In contrast to some noise-cancelling headphones, which generate an anti-noise hardware contained in the headphone based on an ambient noise signal captured via an integrated microphone in close proximity to the designated listening point, in certain embodiments according to this disclosure, to facilitate the use of inexpensive headphones and to perform sound processing using the resources of a more protected device (for example, a smartphone in a user's backpack), an ambient noise signal received at a microphone is passed through one or more layers of audio processing (for example, to account for headphone interface effects, location effects, or microphone effects). According to various embodiments, the additional processing associated with compensating for such effects introduces a latency between when ambient sound is received at a microphone and when an anti-noise signal is reproduced at a headphone. Left uncorrected, this latency can, in some embodiments, put an anti-noise signal out of phase with ambient noise, which can, depending on the size of the latency, result in diminished noise cancellation, or in some cases, amplification of the ambient noise.

In the non-limiting example shown in FIG. 6, a graph 600 of the amplitude of an ambient noise signal (or one waveform making up part of an ambient noise signal), and the amplitude of an anti-noise signal (or one waveform making up part of an anti-noise signal) which is phase delayed due to non-zero latency, as a function of time are shown. According to certain embodiments, a microphone (for example, microphone 379 in FIG. 3) connected to a remote device (for example, remote device 301 in FIG. 3) converts ambient noise into an electric signal, which, in this example is shown as first plot 610 (in dotted lines).

According to some embodiments, the electrical signal represented by first plot 610 is passed along a processing and transmission path (for example, a path including filters 320 through 330 in FIG. 3) to generate an anti-noise signal, which is reproduced at a transducer or speaker in a headphone. Referring to the non-limiting example of FIG. 6, second plot 605 represents the anti-noise signal reproduced at the headphone. As shown in graph 600, at this particular frequency, the non-zero latency of the transmission and processing path creates a phase delay 615 between the peaks of first plot 610 and the troughs of second plot 605. In this example, phase difference 615 is close to 180 degrees, meaning that, instead of canceling out the ambient noise, the anti-noise signal shown by second plot 605 is, in fact, amplified. Depending on the application, this may be desirable (for example, for amplifying sounds outside the headphone interface of interest to a user, such as a baby crying), or undesirable (for example, when the phase shift causes the anti-noise signal to amplify the unwanted sounds of aircraft, traffic or heavy machinery).

According to certain embodiments, time-shift corrections to offset the phasing effects of a known non-zero latency ($\Delta t$) of a transmission and processing path can be determined by performing a fast Fourier transform ($X(\omega_k)$) of a representation of a time domain signal (x) associated with a sound to be cancelled such that:

$$x(n-\Delta t) \leftrightarrow e^{-j\omega\Delta t} * X(\omega_k) \quad (1)$$

Where $X(\omega_k)$ is the FFT of x, $\Delta t$ is the non-zero latency of the processing and transmission path between a microphone and a headphone, x is a representation of the ambient noise signal to be cancelled at a specific time point n in a time domain.

According to some embodiments, corrections for the predicted latency applied to an anti-noise signal can be applied by a filter (for example, latency filter 330) in the remote device.

Figure 7:
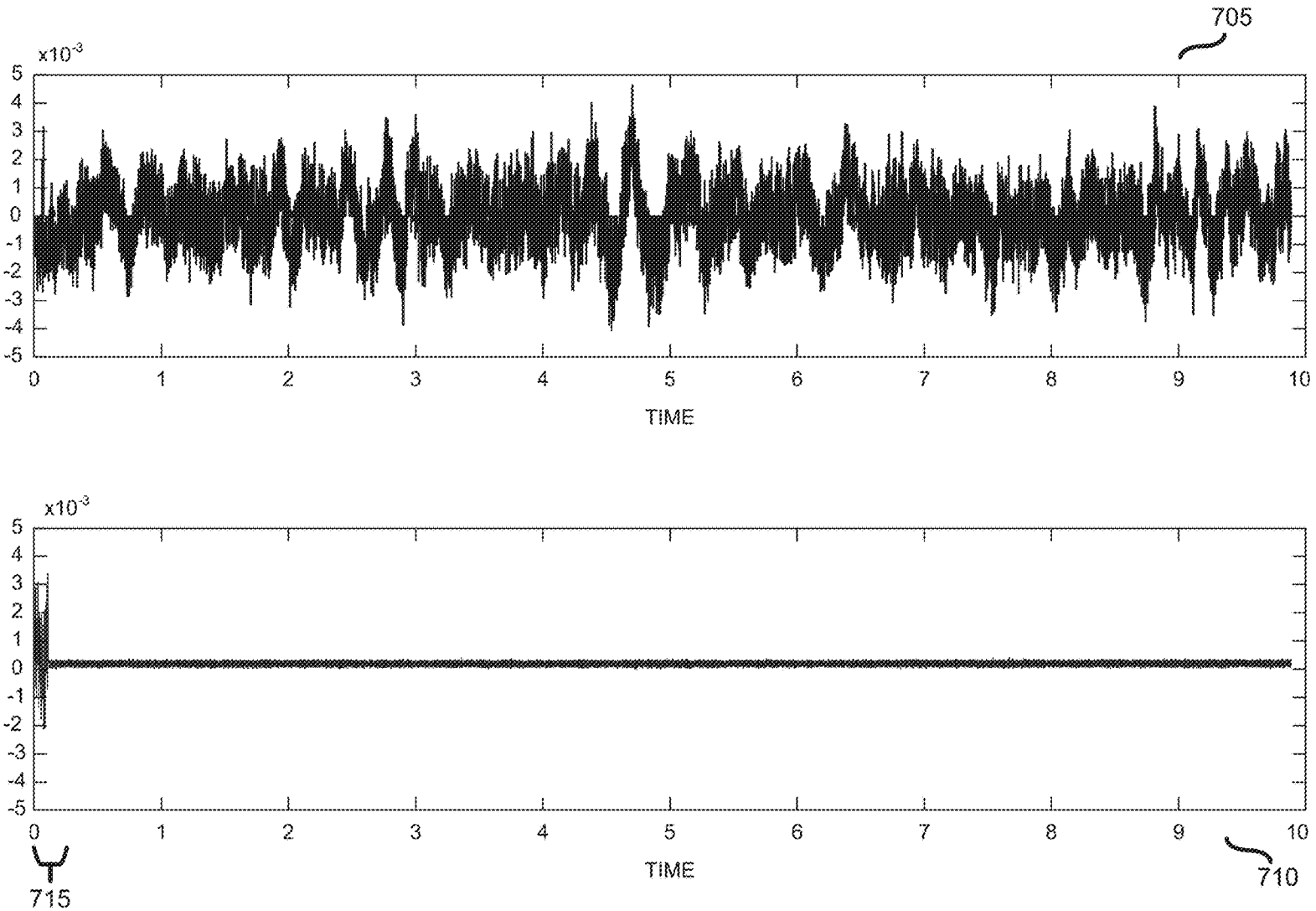
FIG. 7 illustrates an example of a correction for a non-zero latency in a processing and transmission path between a microphone and headphone according to embodiments of this disclosure.

FIG. 7 illustrates an example of a correction for a non-zero latency in a processing and transmission path between a microphone and headphone according to certain embodiments of this disclosure. The example shown in FIG. 7 is for illustration only and other examples could be depicted, produced, or obtained, without departing from the scope of the present disclosure.

As discussed with respect to the illustrative example of FIG. 6 of this disclosure, the technical challenges associated with performing active noise cancellation according to various embodiments of this disclosure include, without limitation, compensating for the non-zero latency arising in the transmission and processing chain between a microphone receiving a noise signal and a headphone reproducing an anti-noise signal which has been corrected, for example, for headphone interface or location effects. According to some embodiments, ensuring the proper phasing between an anti-noise signal and the ambient noise can be achieved through the use of a sound profile comprising a model of the predicted frequencies of components of a profiled sound (for example, jackhammer or traffic noise), and adjusting an output buffer according to the predicted periodicity of the major components of the profiled sound.

In many cases, real-world noises that users may wish to cancel through an anti-noise signal provided at a headphone are, to varying degrees, predictable based on the near-past behavior of the noises. In certain embodiments according to this disclosure, achieving proper phasing between an anti-noise signal and the noise to be canceled can be achieved by predicting the behavior of the ambient noise in the near future based on an initial sample.

According to some embodiments, predictive noise cancellation can be implemented by obtaining a sample of an ambient noise, and associating the sample with one or more predictive models regarding the future behavior of the noise. In certain embodiments, the selection of the predictive model for the ambient noise's future behavior can be assisted through of a user-selected noise profile (for example, a profile in plurality of sound profiles 350 in FIG. 3), which contains information regarding the periodicity of particularly unwanted sounds (for example, the main frequencies of jackhammer or jet engine noise) associated with a particular environment. In some embodiments, a user (or a process on the remote device) may select a sound profile associated with "airport," and the non-zero latency correction may be applied to ensure that, one or more component frequencies of an anti-noise signal are perfectly synchronized with one or more predicted component frequencies (for example, the frequency associated with the fundamental note of jet engine noise) of the ambient noise.

FIG. 7 comprises two plots of amplitude and time providing an example of sampling, and then applying a predictive model to generate an anti-noise signal according to certain embodiments of this disclosure. Referring to the illustrative example of FIG. 7, a first plot 705 shows a representation of the amplitude of an ambient noise (in this case, the noise from a subway train) at a microphone as a function of time. A second plot 710 shows the amplitude of the sound at a designated listening point near a headphone operating under the control of the remote device (for example, designated listening point 375 in FIG. 3) over the same time period as first plot 705. Referring to the non-limiting example of FIG. 7, during an initial time interval, a remote device (for example, remote device 301 in FIG. 3) receives through a microphone, a sample of the noise signal shown by first plot 705, and based, at least in part (a user may also provide an input characterizing the ambient noise) on the obtained sample, selects and applies a predictive model of the ambient noise. According to certain embodiments, the remote device then generates an anti-noise signal based on the selected predictive model, which is reproduced at the headphone. As shown by second plot 710, after the initial interval 715, the predictive model (which may be trained on previously collected audio data for common ambient noises, such as subway and traffic noise) begins generating an anti-noise signal which significantly attenuates the amplitude of the noise signal shown in first plot 705. According to various embodiments, the duration of initial interval 715 reflects both the time required to obtain a sample of the ambient noise, but also, a non-zero latency in the processing and transmission paths (for example, transmission paths 215A and 215B in FIG. 2) between the microphone and headphones.

In certain embodiments, the predictive models for near-future behavior of a sampled noise are pre-trained based on models developed for common species of ambient noise. In some embodiments, predictive models for the near-future behavior of a noise sample can, with sufficiently large data sets, be trained using machine learning techniques, in which one or more models are trained to recognize patterns within representations of noise samples in the time and/or frequency domains.

Figure 8:
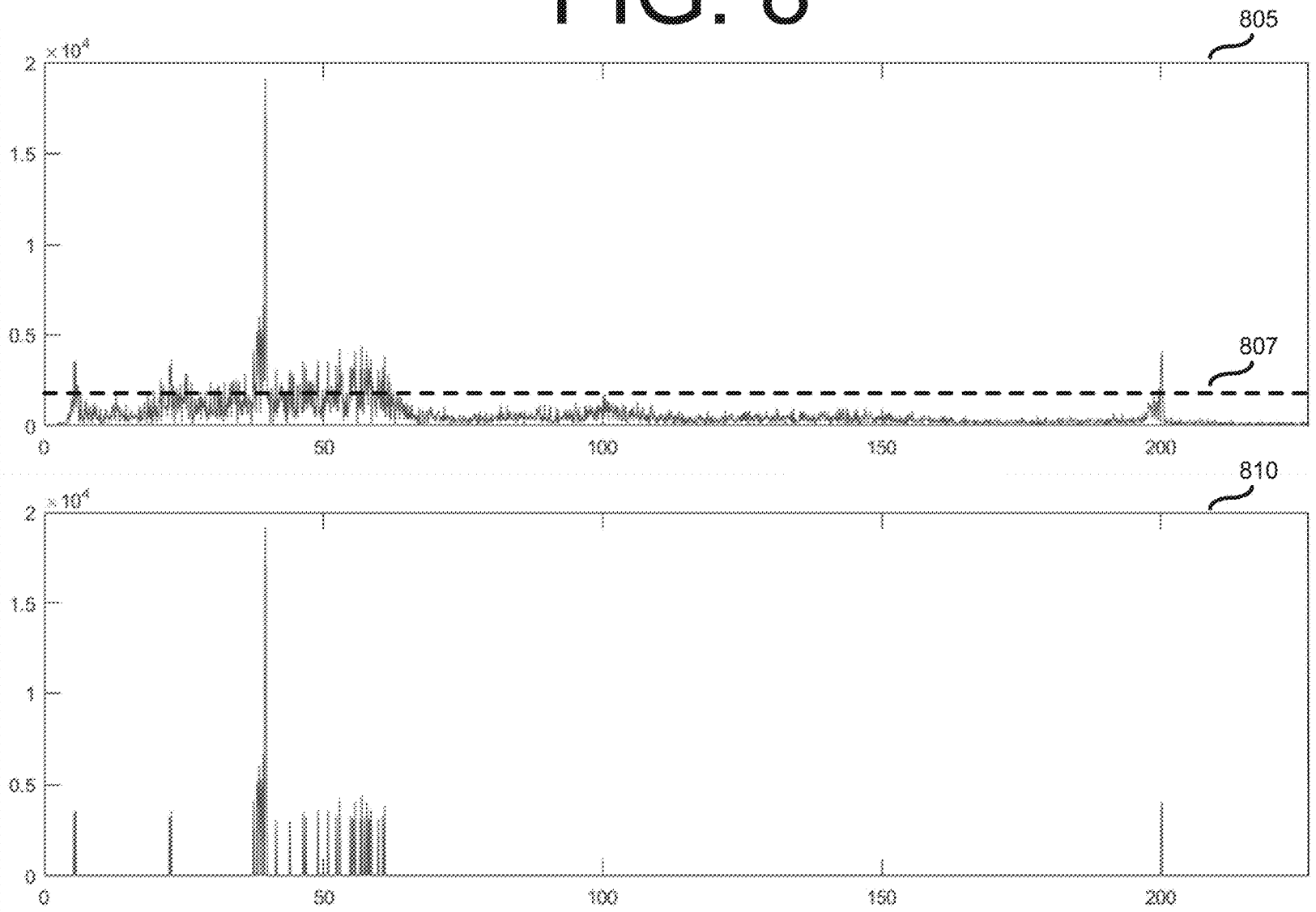
FIG. 8 illustrates aspects of a correction for a non-zero latency in a processing and transmission path between a microphone and headphone according to embodiments of this disclosure.

FIG. 8 illustrates aspects of a correction for a non-zero latency in a processing and transmission path between a microphone and headphone according to some embodiments of this disclosure. The example shown in FIG. 8 is for illustration only and other examples could be depicted, produced, or obtained, without departing from the scope of the present disclosure.

As discussed herein, the technical challenges associated with implementing active noise cancellation according to some embodiments of this disclosure include, without limitation, tuning the phase response of the anti-noise signal to account for the non-zero latency in the processing and transmission path between a microphone receiving ambient noise inputs and a headphone providing anti-noise outputs. Further, depending on the nature of the ambient noise to be cancelled, the magnitude of the time shifts to correct for non-zero latency in the transmission path can vary across frequencies.

In some embodiments, the time shift across the constituent frequencies of a FFT can be calculated (such as described with respect to FIG. 6 of this disclosure). However, many of the sampled frequencies represented in the FFT may be frequencies which make little or no contribution to the overall ambient noise signal. From a processing and performance point of view, calculating time shifts for these minimally contributing frequencies of the FFT can represent an undue processing burden, and potentially diminish the effectiveness of the active noise cancellation.

Various embodiments according to the present disclosure reduce the processing burden associated with calculating latency time corrections for low-contributing frequencies by performing selective noise cancellation, in which an anti-noise signal is generated based on the most obvious, or strongly contributing frequencies of a noise signal to be cancelled. According to some embodiments, the most strongly contributing frequencies can be identified by performing an FFT of a noise signal, and then identifying peaks in the FFT which are above a threshold value.

Referring to the non-limiting example of FIG. 8, two plots 805 and 810 are provided. First plot 805 shows an initial FFT, with amplitude represented on the vertical axis and frequency on the horizontal axis, of a noise signal to be canceled, relative to a threshold value 807. Second plot 810 shows the peaks of the initial FFT which have values greater than threshold amplitude value 807. As shown by this illustrative example, selecting only the components can significantly simplify the FFT from a complicated signal with many sample frequencies providing negligible contributions to an overall noise, to a discrete set of peaks above threshold amplitude 807.

By simplifying the FFT by excluding the frequency components whose contribution falls below amplitude threshold 807, the determination of time shifts for the non-zero latency of transmission and processing path is similarly simplified. According to certain embodiments, once the most prominent peaks of second plot 810 are targeted, additional filtering can be done to separate out the main constituent sinusoids of the noise signal from one another. According to some embodiments, the main constituent sinusoids of the noise signal can be latched onto and separated using one or more known techniques for tracking frequency and phase, including, without limitation, phase locked loop, zero-crossing or max/min crossing techniques. Having identified the constituent sinusoids of the noise signal, a latency filter (for example, latency filter 330 in FIG. 3), can synthesize an anti-noise waveform in real time.

As shown by, without limitation, equation 1 of this disclosure, in certain embodiments according to this disclosure, for a known latency ($\Delta t$) in a transmission and processing path between a microphone input and a headphone output, there is, for any given frequency ($\omega$), a calculable time shift for ensuring that an anti-noise signal is properly phased with a noise signal. Accordingly, in some embodiments according to this disclosure, compensating for the phasing effects caused by the non-zero latency of the transmission and processing path, can be performed without converting a signal to be canceled from a time domain to a frequency domain (by, for example, performing an FFT on the signal). Instead, in certain embodiments according to this disclosure, a sample of a noise signal can be passed through an all-pass filter which imparts a frequency-dependent phase shift which compensates for the phasing effects created by the non-zero latency of the transmission and processing path.

Figure 9:
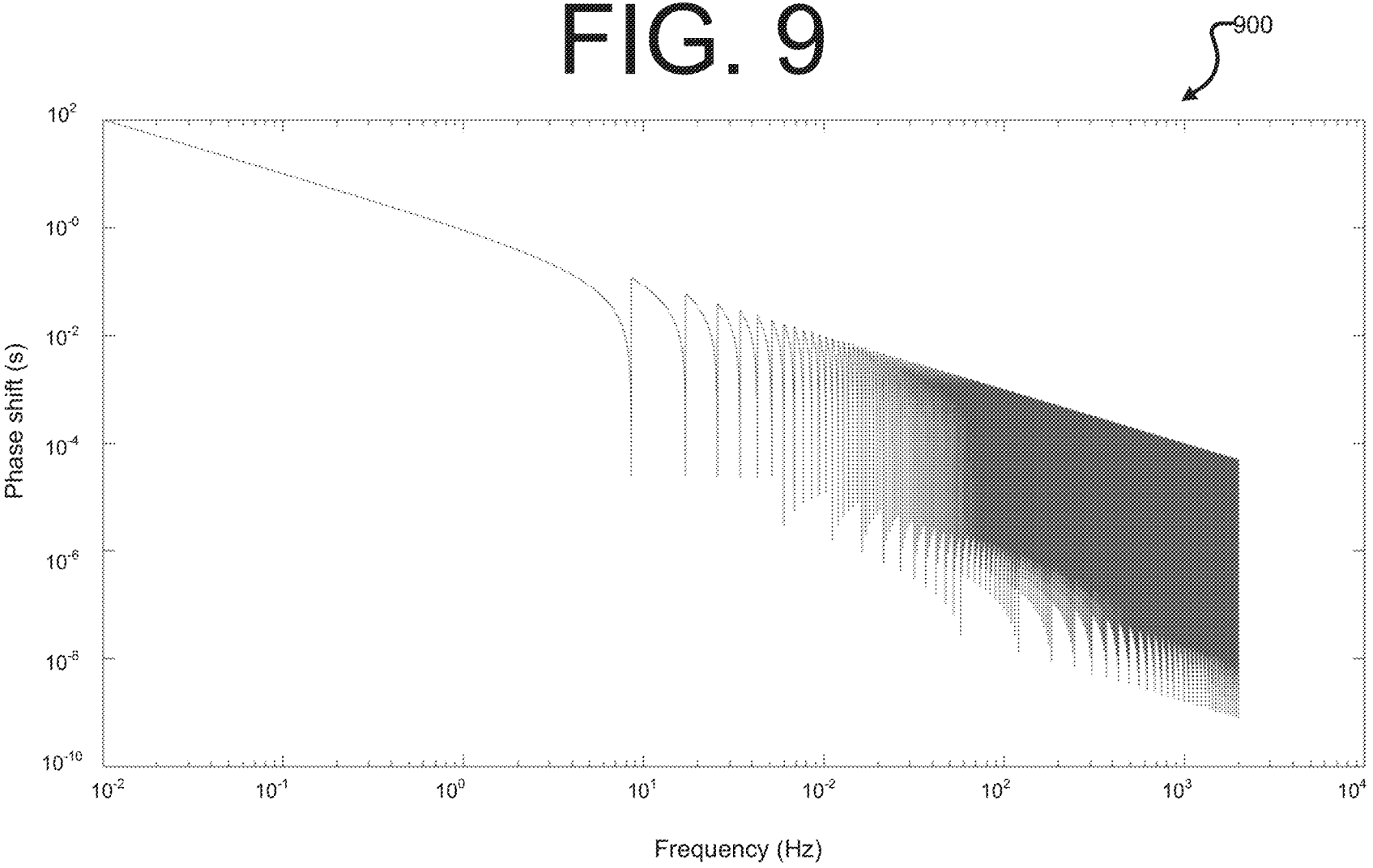
FIG. 9 illustrates aspects of an all-pass filter for correcting for a non-zero latency in a processing and transmission path between a microphone and headphone according to embodiments of this disclosure.

Referring to the illustrative example of FIG. 9, the phase shift-frequency response curve 900 for an all-pass filter designed to offset the latency-created phasing effects is shown. As shown in the illustrative example of FIG. 9, the phasing effects of a constant delay in a transmission and processing path from a noise signal generated at a microphone to an anti-noise signal produced at a headphone can be corrected through an all-pass filter having a phase shift/frequency response curve such as shown in FIG. 9. In certain embodiments, a sample of noise data can be passed through an all-pass filter having response curve 900 to generate an anti-noise waveform without having to transform the noise signal from the time domain to the frequency domain.

Figure 10:
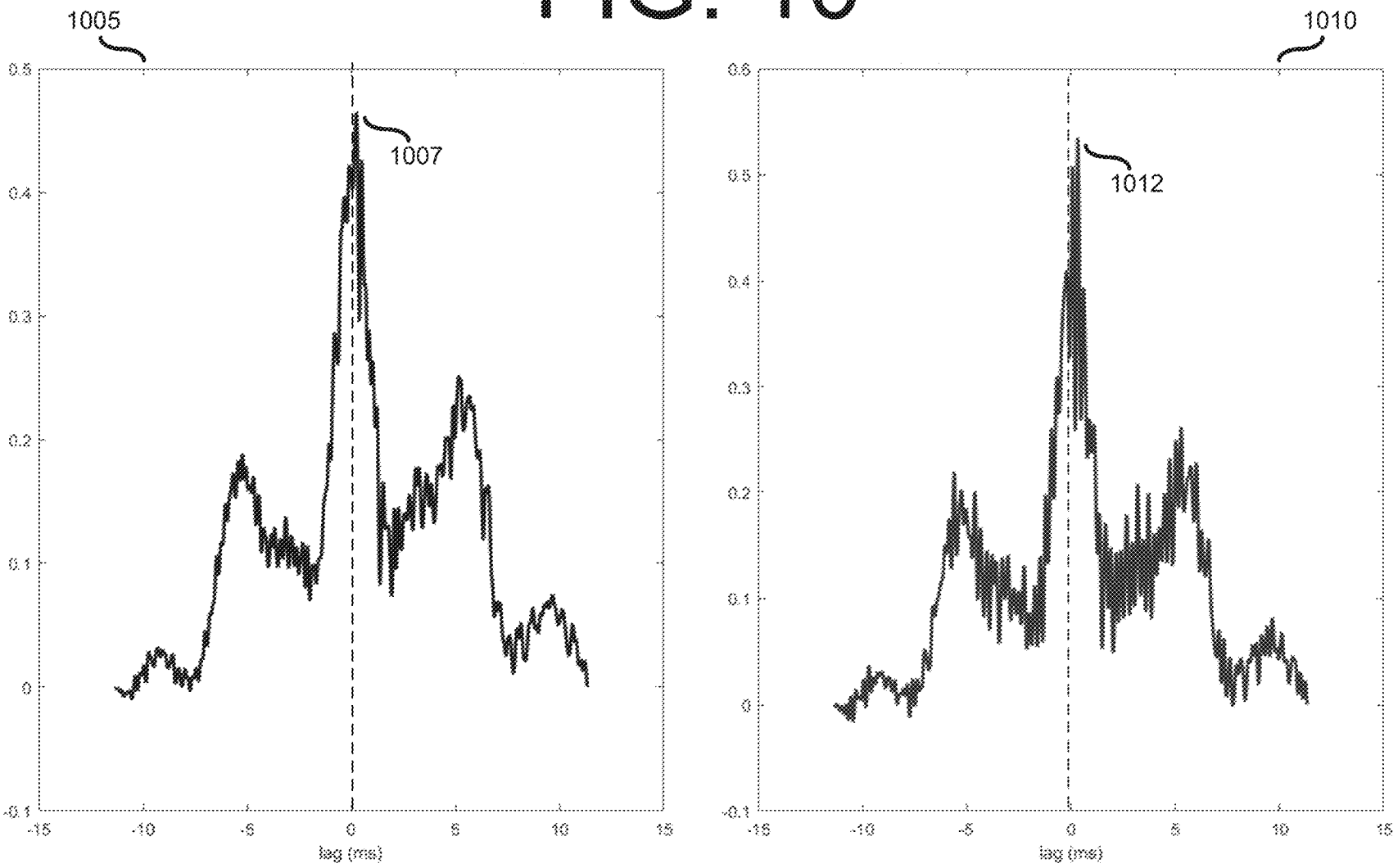
FIG. 10 illustrates aspects of a microphone location effect addressed by active noise cancellation according to embodiments of this disclosure.

FIG. 10 illustrates aspects of a microphone location effect addressed by active noise cancellation according to various embodiments of this disclosure. The example shown in FIG. 10 is for illustration only and other examples could be depicted, produced, or obtained, without departing from the scope of the present disclosure.

As discussed elsewhere herein, certain embodiments according to this disclosure facilitate the provision of active noise cancellation while generally permitting users to use the headphone and microphone combination of their choice, including inexpensive headphone/microphone apparatus with earbud headphones and an in-line or wireless microphone (for example, microphone 205 in FIG. 2) which, when the apparatus is worn, is either in the expected vicinity of a user's mouth, or near her ear.

The interplay between sound waves and the surfaces of a human head, as well as the physical distance between the microphone gathering a noise signal and a designated listening point can, in certain embodiments, create filtering and phasing effects, which left uncorrected, can undermine the effectiveness of an anti-noise signal generated at a remote device (for example, device 100 in FIG. 1).

Referring to the non-limiting example of FIG. 10, two plots, 1005 and 1010 are provided to illustrate an example of a microphone location effect which can be addressed by certain embodiments according to this disclosure. Specifically, FIG. 10 depicts the result of an experiment in which the ambient sound in a room is measured from the following three locations: a location corresponding to a listener's right ear, a location corresponding to the listener's left ear and a location corresponding to the location of an in-line microphone (for example, a location near the listener's mouth). Specifically, first plot 1005 illustrates cross-correlation values between the sound recorded at the location corresponding to the listener's right ear and the location corresponding to the location of an in-line microphone as a function of time lag. Similarly, second plot 1010 illustrates cross correlation values between the sound recorded at the location corresponding to the listener's left ear and the location corresponding to the location of the in-line microphone as a function of time lag. As shown in the illustrative example of FIG. 10, in first plot, 1005, peak correlation between the sound recorded at the location associated with in-line microphone and the right ear occurs at point 1007, which is associated with a near zero-lag between the sound as recorded in these two locations.

Referring again to the illustrative example of FIG. 10, second plot 1010 illustrates cross correlation values between the sound signal as recorded at a location corresponding to a listener's left ear, and a sound signal as recorded at a location corresponding to the location of an in-line microphone. In second plot 1010, the peak correlation between the signal recorded at the left ear location and the signal recorded at the location associated with the position of an in-line microphone occurs at point 1012, which occurs at a greater lag interval than point 1007. Thus, the differences in recording location create a slight delay effect across listening points. Location effects, or the slight differences in phase (for example, as illustrated through FIG. 10) and amplitude arising from, without limitation, the physical separation between an input microphone and output headphone, can, in certain embodiments, be compensated for by measuring the effects for one or more combinations of microphone and headphone and building predictive models to compensate for location effects. According to some embodiments, models for combinations of headphones and microphones can be stored as part of a set of equipment profiles (for example, one of equipment profiles 345 in FIG. 3) maintained in a remote device performing active noise cancellation according to embodiments of this disclosure. In certain embodiments, the phasing effects caused by differences in time lag between when unwanted noise is received at a designated listening point and when unwanted noise is received at an input microphone, can be compensated using one or more of the techniques described with reference to FIGS. 6-9 of this disclosure, for compensating for the phasing effects arising from non-zero latency in a transmission and processing path. According to some embodiments, the filtering effects arising from location effects can be corrected using one or more of the techniques for compensating for filtering from headphone interface effects described with reference to FIG. 5 of this disclosure.

Figure 11:
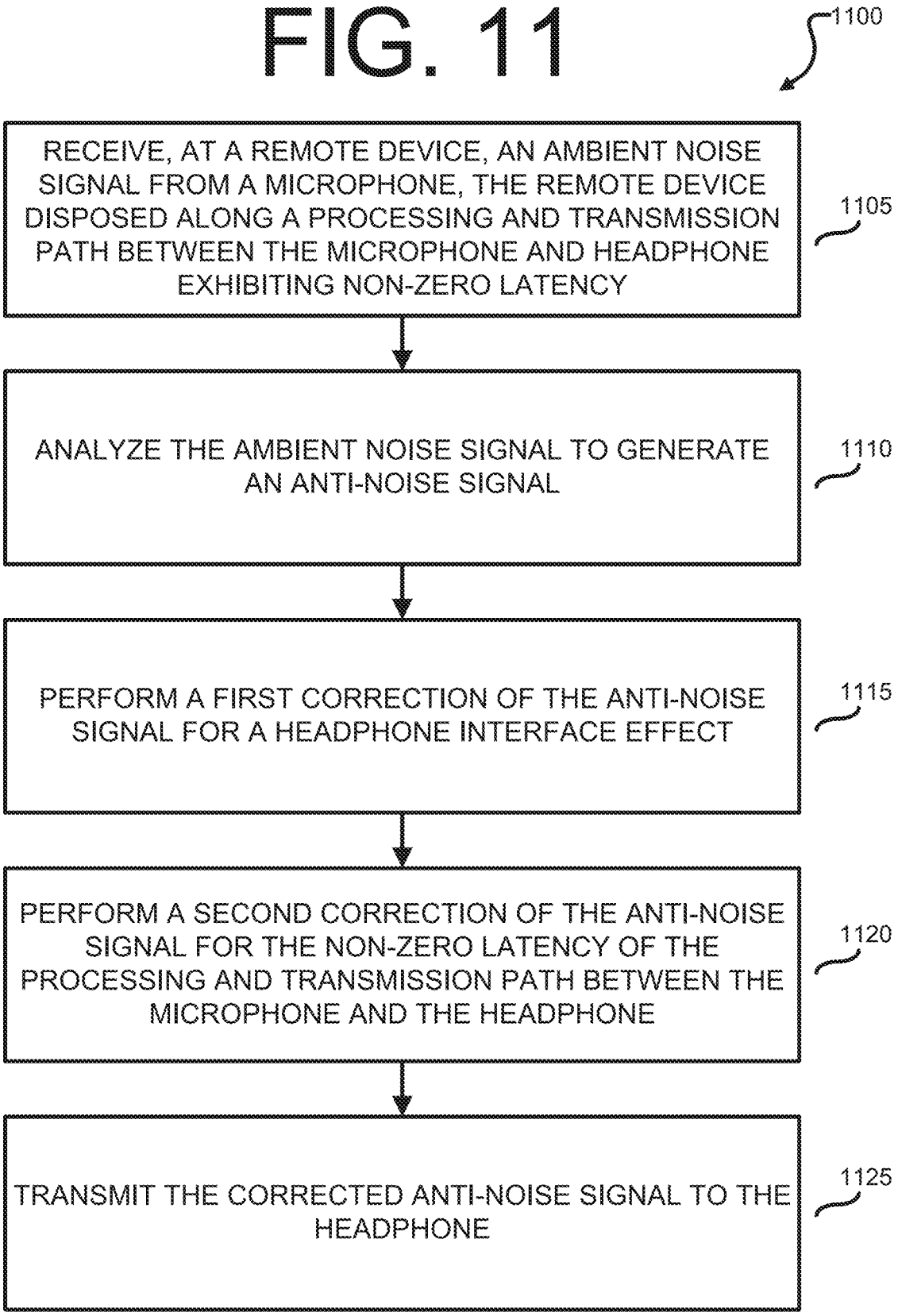
FIG. 11 illustrates operations of an example of a method for implementing active noise cancellation at a remote device according to embodiments of this disclosure.

FIG. 11 illustrates operations of an example of a method 1100 for implementing active noise cancellation at a remote device according to certain embodiments of this disclosure. While the flow chart depicts a series of sequential steps, unless explicitly stated, no inference should be drawn from that sequence regarding specific order of performance, performance of steps or portions thereof serially rather than concurrently or in an overlapping manner, or performance of the steps depicted exclusively without the occurrence of intervening or intermediate steps. The process depicted in the example depicted is implemented by a processor in, for example, a mobile station.

Referring to the non-limiting example of FIG. 11, at operation 1105, a remote device (for example, remote device 201 in FIG. 2) receives, from a microphone (for example, microphone 379 in FIG. 3) a noise signal (for example, an ambient, or background noise signal). According to certain embodiments, the remote device is disposed along a processing and transmission path (for example, the path comprising transmission paths 215A and 215B in FIG. 2) exhibiting non-zero latency.

As shown in the illustrative example of FIG. 11, at operation 1110, the remote device analyzes the ambient noise signal to generate an anti-noise signal. According to certain embodiments, the analysis of the ambient noise signal and generation of the anti-noise signal is performed by passing an ambient noise signal (for example, the ambient noise signal obtained at operation 1105) through a transmission and processing path (for example, the transmission and processing path between microphone 379 and headphone 371 in FIG. 3). In some embodiments, the transmission and processing path includes one or more filters for correcting for location effects, headphone interface effects or phasing effects associated with the non-zero latency of the transmission and processing path. Thus, in certain embodiments according to this disclosure, operation 1110 may be performed at the same time as one or more of operations 1115 and 1120 in FIG. 11, or certain operations described herein with reference to FIGS. 12A through 12F. Further, while the illustrative example of FIG. 11 describes embodiments wherein an anti-noise signal is initially generated and subsequently processed to correct for, without limitation, non-zero latency effects, other embodiments are possible and within the contemplated scope of this disclosure. For example, in certain embodiments, corrections for non-zero latency or location effects are applied to a noise signal, and an anti-noise signal is subsequently generated from the processed noise signal.

In various embodiments according to this disclosure, at operation 1115, the remote device, or a component thereof (for example, headphone interface filter 325 in FIG. 3) performs a first correction of the anti-noise signal (or the constituent waveforms of a transform of the anti-noise signal in a frequency domain) to correct for a headphone interface effect (for example, the phasing and filtering effects described with reference to FIG. 5 of this disclosure). According to some embodiments, the corrections for headphone interface effects may be performed based on a stored profile for the headphone (for example, a profile in the one or more equipment profiles 345 in FIG. 3) which contains a predictive model of the expected interface effects based on measurements of the frequency and amplitude effects of a given headphone interface.

According to some embodiments of this disclosure, at operation 1120, the remote device or a component thereof (for example, latency filter 330 in FIG. 3) performs a second correction of the anti-noise signal (or the constituent waveforms of a transform of the anti-noise signal in a frequency domain) to correct for the phasing effects associated with the non-zero latency of the transmission path. In certain embodiments, the correction for the non-zero latency can be performed analytically, by applying equation 1 to a transform of the ambient noise signal to determine corrective time shifts for each of the constituent waveforms of the transforms. According to some embodiments, the correction for non-zero latency may be performed formed by excluding frequencies below a threshold value to simplify the transform and then using zero-crossing or other numerical techniques to identify the frequencies of the most prominent peaks and synthesize anti-noise waveforms with the correct time shifts. In certain embodiments, the correction for the non-zero latency may be applied based on a predetermined profile or predetermined model of the ambient noise. In certain embodiments, once a predetermined model is selected based on the sampled noise, a correction for a phase offset due to non-zero latency and other effects is applied to generate an anti-noise signal. In at least one embodiment, (for example, embodiments as described with reference to FIG. 9 of this disclosure) the correction for the non-zero latency can be performed without a transform into a frequency domain, by passing the noise (or anti-noise signal) through an all-pass filter with a frequency/phase response tuned to compensate for the phasing effects caused by the non-zero latency of the transmission and processing path.

Referring to the non-limiting example of FIG. 11, at operation 1125, the corrected anti-noise signal (for example, ń in FIG. 3, is transmitted to the headphone) to be reproduced as an audible waveform to be received at a designated listening point (for example, designated listening point 220 in FIG. 2).

FIGS. 12A through 12F illustrate operations of methods for performing active noise cancellation at a remote device according to some embodiments of this disclosure. The operations described with reference to FIGS. 12A through 12F are, in certain embodiments, performed in conjunction with, or in lieu of certain operations of methods according to this disclosure for performing active noise cancellation (for example, method 1100 in FIG. 11).

Figure 12A:
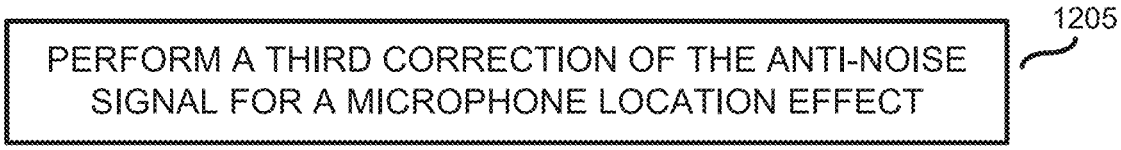
FIGS. 12A through 12F illustrate operations of methods for implementing active noise cancellation at a remote device according to embodiments of this disclosure.

Referring to the non-limiting example of FIG. 12A, at operation 1205, the remote device (or one or more components thereof, such as location filter 320 in FIG. 3) performs a third correction of the anti-noise signal (or the constituent waveforms of a transform of the anti-noise signal in a frequency domain) for location effects associated with the positioning of the microphone relative to the designated listening point. According to some embodiments, the location effects comprise phasing effects caused by the physical distance between the designated listening point and the microphone (for example, as shown in FIG. 10 of this disclosure), or acoustic effects caused by the surfaces of a listener's head, or the response curve of the microphone. In some embodiments according to this disclosure, operation 1205 is performed based, at least in part, on a stored profile for the headphone and microphone (for example, a profile in the one or more equipment profiles 345 in FIG. 3) which contains a predictive model of the expected microphone location effects based on measurements of the frequency and amplitude effects of a given microphone. According to certain embodiments, at operation 1205, the remote device can perform the third correction for location effects based on a headphone profile, wherein the headphone profile accounts for location effects arising from the headphone's intended position relative to intended listening points and an intended microphone position.

Figure 12B:
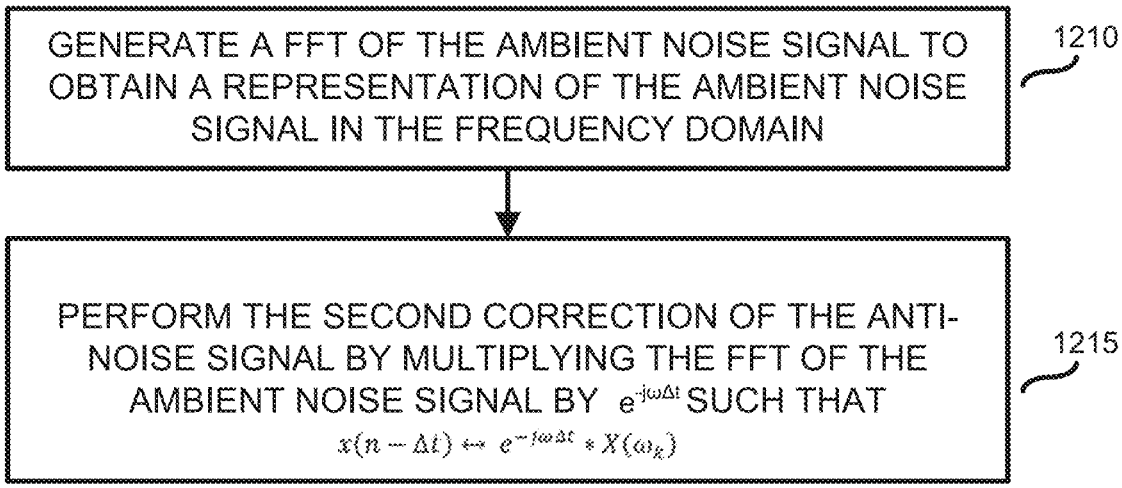

Referring to the non-limiting example of FIG. 12B, in various embodiments according to this disclosure, at operation 1210, the remote device generates a fast Fourier transform (for example, FFT 315 in FIG. 3) to obtain a representation of the ambient noise signal in the frequency domain (for example, representation 450 in FIG. 4).

According to some embodiments of this disclosure, at operation 1215, the remote device (for example, remote device 201 in FIG. 2) performs a second correction of the anti-noise signal to account for the phasing effects caused by the non-zero latency of the transmission and processing path by multiplying a FFT (for example, the FFT generated at operation 1210) by $e^{-j\omega\Delta t}$ such that $x(n-\Delta t) \leftrightarrow e^{-j\omega\Delta t} * X(\omega_k)$ where $\Delta t$ represents the non-zero latency of the processing and transmission path between the microphone and the headphone, where x is the ambient noise signal in a time domain, and where $X(\omega_k)$ represents the FFT of x. In this non-limiting example of performing a correction to account for phasing effects, by multiplying the FFT of the ambient noise signal by $e^{-j\omega\Delta t}$ as described, corrective time shifts for the constituent waveforms of the FFT of the anti-noise signal can be determined and applied to ensure that the anti-noise signal is phased to fully cancel (rather than partially cancel, or worse yet, amplify) the ambient noise.

Figure 12C:
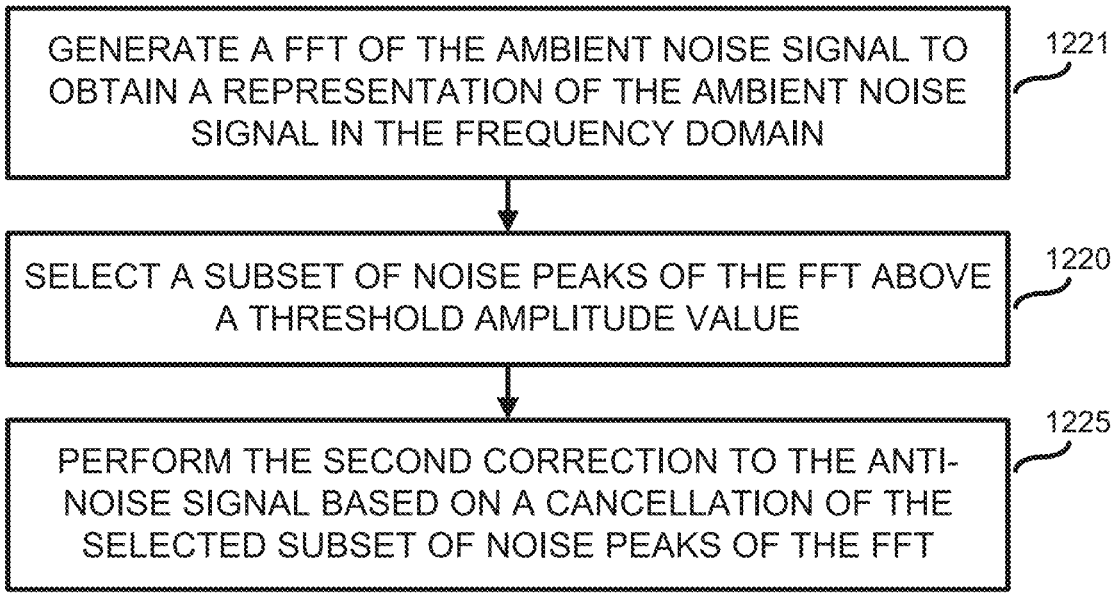

As shown in the non-limiting example of FIG. 12C, at operation 1221, the remote device generates a fast Fourier transform (for example, FFT 315 in FIG. 3) to obtain a representation of the ambient noise signal in the frequency domain (for example, representation 450 in FIG. 4).

In various embodiments according to this disclosure, at operation 1220, the remote device selects a subset of noise peaks of a fast Fourier transform (for example, the FFT generated at operation 1210) as the basis for generating the anti-noise signal. According to certain embodiments, the subset of noise peaks of the FFT is selected based on identification of noise peaks with amplitudes above a threshold value (for example, the noise peaks shown in second plot 810 in FIG. 8.

As shown in the non-limiting example of FIG. 12C, at operation 1225, the remote device performs the second correction to the anti-noise signal (for phasing effects caused by a non-zero latency in a processing and transmission path between a microphone receiving a noise signal and a headphone reproducing an anti-noise signal) based on the selected subset of the noise peaks of the FFT (for example, the subset of noise peaks selected at operation 1220). According to certain embodiments, the frequencies associated with the selected peaks can be determined using one or more of phase locked loop, zero-crossing, and/or maximum/minimum crossing techniques to identify the sinusoids for which time offsets need to be determined. Such sinusoids can then be synthesized to give rise to the corrected anti-noise signal.

Figure 12D:
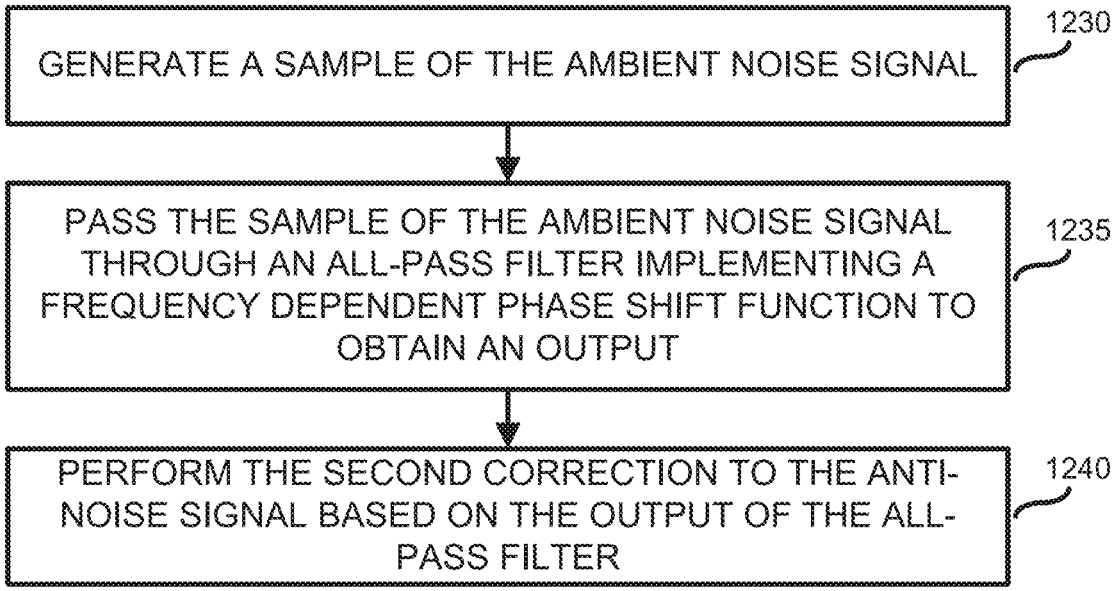

Referring to the non-limiting example of FIG. 12D, at operation 1230, the remote device generates a sample of the ambient noise signal. In certain embodiments, generating a sample comprises storing the values of an electronic signal associated with the ambient noise over a predetermined period in a memory of the device (for example, input data buffer 310 in FIG. 3). In some embodiments, the sample of the ambient noise signal is maintained in the time domain. In various embodiments, the sample of the ambient noise signal is transformed to the frequency domain.

According to various embodiments, at operation 1235, the remote device passes a sample of an ambient noise signal (for example, the sample generated at operation 1230) through an all pass filter (for example, an all-pass filter having phase shift/frequency response curve 900 to obtain an output. In some embodiments, operation 1235 is performed in conjunction with other operations for correcting a non-zero latency effect.

In some embodiments according to this disclosure, at operation 1240, the remote device performs the second correction to an anti-noise based on the output of the all-pass filter. According to some embodiments, the output of the all-pass filter comprises an anti-noise signal in the time domain, and operation 1240 comprises providing a signal based on the output of the all-pass filter to a headphone for reproduction as audible sound. In some embodiments, at operation 1240, the output of the all-pass filter is inverted to generate an anti-noise signal, which can be reproduced on loop, at a headphone as an anti-noise signal. According to certain embodiments, the all-pass filter fully corrects for the effects of non-zero latency, and performing the second correction comprises passing the output of the all-pass filter to the next stage in the processing chain. In some embodiments, the output of the all-pass filter requires further processing as part of performing the second correction.

Figure 12E:
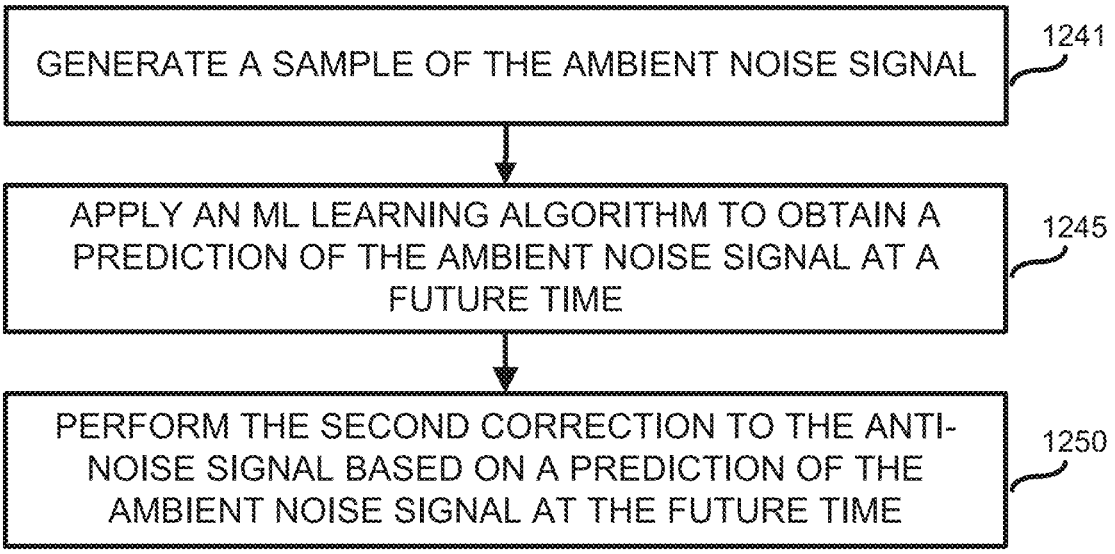

As shown in the non-limiting example of FIG. 12E, at operation 1241, the remote device generates a sample of the ambient noise signal (for example, the sample generated at operation 1230 of FIG. 12D).

According to various embodiments, at operation 1245, the remote device applies a machine learning (ML) algorithm to obtain a prediction of the ambient noise signal at a future time. According to certain embodiments, the ML algorithm analyzes one or more representations of the ambient noise signal (for example, a spectrogram of the noise over time), and analogous to image recognition techniques, recognize features within the spectrogram, and generate an anti-noise signal based on the recognized features.

In some embodiments according to this disclosure, at operation 1250, the remote device performs a second correction of the ambient noise signal at the future time. According to various embodiments, the second correction is performed by applying a compensating time shift for the non-zero latency in the processing and transmission path between the microphone and headphone to an anti-noise signal generated based on a predictive model, such as an ML algorithm, or sound models (for example, a sound profile drawn from the one or more sound profiles 350 in FIG. 3). According to certain embodiments, the anti-noise signal generated by the predictive model fully compensates for the effects of non-zero latency, and performing the second correction comprises passing the anti-noise signal generated by the predictive model to the next stage in the processing path. In some embodiments, the anti-noise signal generated by the predictive model requires further processing to account for non-zero latency effects.

Figure 12F:
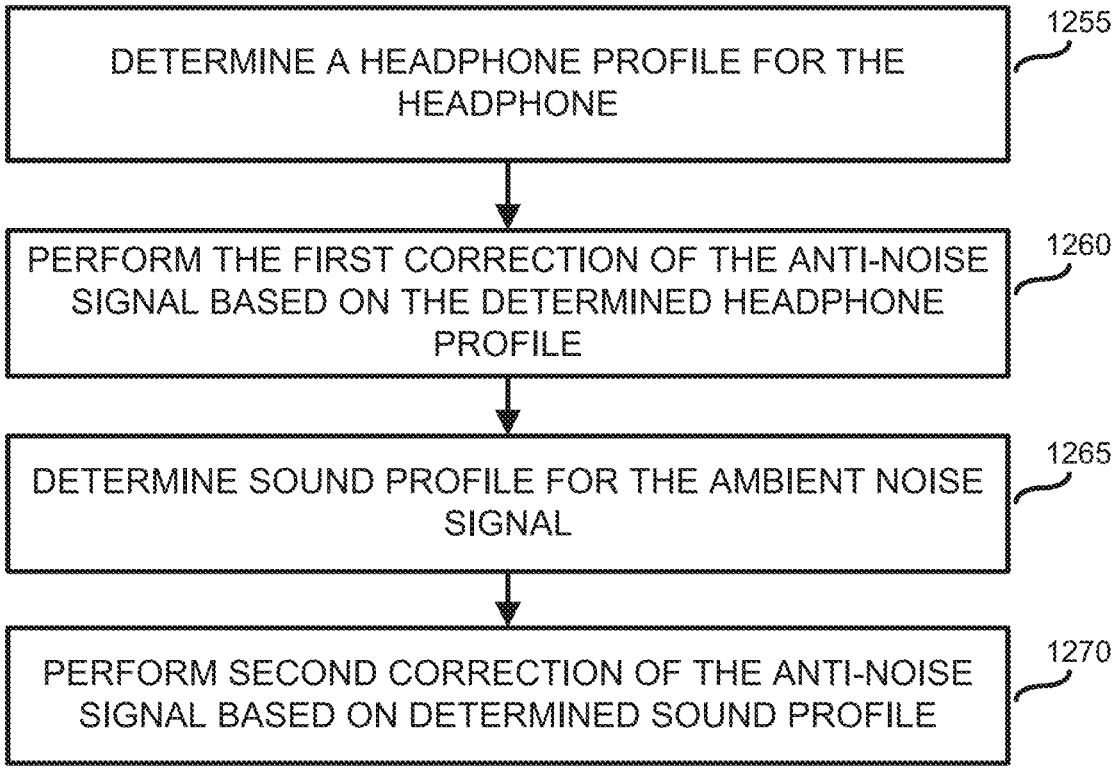

Referring to the non-limiting example of FIG. 12F, at operation 1255, the remote device (or one or more components thereof, such as location filter 320 or headphone interface filter 325 in FIG. 3) determines a headphone profile (for example a profile in one or more equipment profiles 345 in FIG. 3) for the headphone. In certain embodiments, the remote device determines, instead of, or in addition to, a headphone profile, a microphone profile. In various embodiments, the remote device determines an equipment profile for a device, or class of devices (for example, inexpensive earbuds) which includes both a headphone and a microphone.

As shown in the illustrative example of FIG. 12F, at operation 1260, the remote device performs a first correction of the anti-noise signal based on the determined headphone profile. According to certain embodiments, the first correction is to adjust the anti-noise signal for frequency-variant phasing and amplitude effects which cause an ambient noise signal to be changed by interactions with the headphone interface, as well as interactions with the microphone interface, such as described with reference to FIG. 5 of this disclosure.

According to various embodiments, at operation 1265, the remote device, or a component thereof (for example, latency filter 330) determines a sound profile for the ambient noise signal. In some embodiments, the remote device determines the sound profile in response to a user input (for example, selection of a type of background noise, such as "subway noise" from a menu). In certain embodiments, the determination of the sound profile is done programmatically, from an analysis of an ambient noise signal and/or extrinsic information (for example, location data indicating likely sources of nearby noise, such as subways or airports). In certain embodiments according to this disclosure, the sound profile determined at operation 1265 includes data regarding the most prominent frequencies (for example, frequencies above a threshold amplitude, such as shown by second plot 810 in FIG. 8) of the ambient noise associated with the profiled sound.

In some embodiments according to this disclosure, at operation 1270, the remote device performs a second correction to account for, without limitation, the phasing effects caused by the non-zero latency of a transmission and processing path based on a determined sound profile (for example, the sound profile determined at operation 1265). According to certain embodiments, performing the second correction includes generating anti-noise waveforms at the most prominent frequencies of the determined sound profile, and determining time shift corrections for the waveforms which cancel the ambient noise.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. A method of remote active noise correction at a remote device, the method comprising:

receiving, at a processor of the remote device, an ambient noise signal from a microphone, wherein the remote device is disposed along a processing and transmission path between the microphone and a headphone, the processing and transmission path exhibiting non-zero latency;

analyzing, by the processor, the ambient noise signal to generate an anti-noise signal;

performing, by the processor, a first correction of the anti-noise signal for a headphone interface effect, the headphone interface effect arising between the headphone and a designated listening point;

performing, by the processor, a second correction of the anti-noise signal for the non-zero latency of the processing and transmission path between the microphone and the headphone; and transmitting the corrected anti-noise signal to the headphone.

2. The method of claim 1, further comprising:

performing a third correction of the anti-noise signal for a microphone location effect.

3. The method of claim 1, further comprising:

generating a fast Fourier transform (FFT) of the ambient noise signal to obtain a representation of the ambient noise signal in a frequency domain, wherein performing the second correction of the anti-noise signal is based on multiplying the FFT of the ambient noise signal by $e^{-j\omega\Delta t}$ such that $$x(n-\Delta t) \leftrightarrow e^{-j\omega\Delta t} * X(\omega_k)$$

wherein Δt represents the non-zero latency of the processing and transmission path between the microphone and the headphone, wherein x is the ambient noise signal in a time domain, and wherein $X(\omega_k)$ represents the FFT of x.

4. The method of claim 1, further comprising:

generating a fast Fourier transform (FFT) of the ambient noise signal to obtain a representation of the ambient noise signal in a frequency domain; and selecting a subset of noise peaks of the FFT above a threshold amplitude value, wherein performing the second correction to the anti-noise signal is based on a cancellation of the selected subset of noise peaks of the FFT.

5. The method of claim 1, further comprising:

generating a sample of the ambient noise signal; and passing the sample of the ambient noise signal through an all-pass filter implementing a frequency dependent phase shift function to obtain an output, wherein performing the second correction to the anti-noise signal is based on the output of the all-pass filter.

6. The method of claim 1, further comprising:

generating a sample of the ambient noise signal; and applying a machine learning algorithm to obtain a prediction of the ambient noise signal at a future time, wherein performing the second correction to the anti-noise signal is based on the prediction of the ambient noise signal at the future time.

7. The method of claim 1, further comprising:

determining a headphone profile for the headphone, wherein performing the first correction of the anti-noise signal is based on the determined headphone profile, and wherein the headphone profile comprises a prediction of the headphone interface effect for the headphone.

8. The method of claim 1, further comprising:

determining a sound profile for the ambient noise signal, wherein performing the second correction of the anti-noise signal is based on the determined sound profile, wherein the sound profile comprises a prediction of one or more dominant frequency components of the ambient noise signal.

9. A remote device, comprising:

an audio interface connected to a microphone and a headphone;

a processor; and a memory, containing instructions, which, when executed by the processor cause the remote device to:

receive, by the processor, an ambient noise signal from the microphone, wherein the remote device is disposed along a processing and transmission path between the microphone and the headphone, the processing and transmission path exhibiting non-zero latency, analyze, by the processor, the ambient noise signal to generate an anti-noise signal, perform, by the processor, a first correction of the anti-noise signal for a headphone interface effect, the headphone interface effect arising between the headphone and a designated listening point, perform, by the processor, a second correction of the anti-noise signal for the non-zero latency of the processing and transmission path between the microphone and the headphone, and transmit the corrected anti-noise signal to the headphone.

10. The remote device of claim 9, wherein the memory contains instructions, which when executed by the processor, cause the remote device to:

perform a third correction of the anti-noise signal for a microphone location effect.

11. The remote device of claim 9, wherein the memory contains instructions, which when executed by the processor, cause the remote device to:

generate a fast Fourier transform (FFT) of the ambient noise signal to obtain a representation of the ambient noise signal in a frequency domain, and perform the second correction of the anti-noise signal based on multiplying the FFT of the ambient noise signal by $e^{-j\omega\Delta t}$ such that $$x(n-\Delta t) \leftrightarrow e^{-j\omega\Delta t} * X(\omega_k)$$

wherein Δt represents the non-zero latency of the processing and transmission path between the microphone and the headphone, wherein x is the ambient noise signal in a time domain, and wherein $X(\omega_k)$ represents the FFT of x.

12. The remote device of claim 9, wherein the memory contains instructions, which, when executed by the processor, cause the remote device to:

generate a fast Fourier transform (FFT) of the ambient noise signal to obtain a representation of the ambient noise signal in a frequency domain, select a subset of noise peaks of the FFT above a threshold amplitude value, and perform the second correction to the anti-noise signal based on a cancellation of the selected subset of noise peaks of the FFT.

13. The remote device of claim 9, wherein the memory contains instructions, which, when executed by the processor, cause the remote device to:

generate a sample of the ambient noise signal, pass the sample of the ambient noise signal through an all-pass filter implementing a frequency dependent phase shift function to obtain an output, and perform the second correction to the anti-noise signal based on the output of the all-pass filter.

14. The remote device of claim 9, wherein the memory contains instructions, which when executed by the processor, cause the remote device to:

generate a sample of the ambient noise signal, apply a machine learning algorithm to obtain a prediction of the ambient noise signal at a future time, and perform the second correction to the anti-noise signal based on the prediction of the ambient noise signal at the future time.

15. The remote device of claim 9, wherein the memory contains instructions, which when executed by the processor, cause the remote device to:

determine a headphone profile for the headphone, and perform the first correction of the anti-noise signal based on the determined headphone profile, wherein the headphone profile comprises a prediction of the headphone interface effect for the headphone.

16. The remote device of claim 9, wherein the memory contains instructions, which, when executed by the processor, cause the remote device to:

determine a sound profile for the ambient noise signal, and perform the second correction of the anti-noise signal based on the determined sound profile, wherein the sound profile comprises a prediction of one or more dominant frequency components of the ambient noise signal.

17. A non-transitory, computer-readable medium comprising program code, which when executed by a processor, causes a remote device to:

receive, at the remote device, an ambient noise signal from a microphone, wherein the remote device is disposed along a processing and transmission path between the microphone and a headphone, the processing and transmission path exhibiting non-zero latency, analyze the ambient noise signal to generate an anti-noise signal, perform a first correction of the anti-noise signal for a headphone interface effect, the headphone interface effect arising between the headphone and a designated listening point, perform a second correction of the anti-noise signal for the non-zero latency of the processing and transmission path between the microphone and the headphone, and transmit the corrected anti-noise signal to the headphone.

18. The non-transitory, computer-readable medium of claim 17, further comprising program code, which, when executed by the processor, causes the remote device to:

perform a third correction of the anti-noise signal for a microphone location effect.

19. The non-transitory, computer-readable medium of claim 17, further comprising program code, which, when executed by the processor, causes the remote device to:

generate a fast Fourier transform (FFT) of the ambient noise signal to obtain a representation of the ambient noise signal in a frequency domain, and perform the second correction of the anti-noise signal based on multiplying the FFT of the ambient noise signal by $e^{-j\omega\Delta t}$ such that $$x(n-\Delta t) \leftrightarrow e^{-j\omega\Delta t} * X(\omega_k)$$

wherein $\Delta t$ represents the non-zero latency of the processing and transmission path between the microphone and the headphone, wherein x is the ambient noise signal in a time domain, and wherein $X(\omega_k)$ represents the FFT of x.

20. The non-transitory, computer-readable medium of claim 17, further comprising program code, which, when executed by the processor, causes the remote device to:

generate a fast Fourier transform (FFT) of the ambient noise signal to obtain a representation of the ambient noise signal in a frequency domain, select a subset of noise peaks of the FFT above a threshold amplitude value, and perform the second correction to the anti-noise signal based on a cancellation of the selected subset of noise peaks of the FFT.

* * * * *